US008631590B2

(12) United States Patent
Droege et al.

(10) Patent No.: US 8,631,590 B2
(45) Date of Patent: Jan. 21, 2014

(54) ARTICLE OF FOOTWEAR FOR SOCCER

(75) Inventors: John Droege, Portland, OR (US); Paul Hooper, Vancouver, WA (US); Tetsuya T. Minami, Portland, OR (US); Morgan Stauffer, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 744 days.

(21) Appl. No.: 12/133,156

(22) Filed: Jun. 4, 2008

(65) Prior Publication Data

US 2009/0300945 A1 Dec. 10, 2009

(51) Int. Cl.

| | |
|---|---|
| ***A43B 13/00*** | (2006.01) |
| ***A43B 13/14*** | (2006.01) |
| ***A43B 13/38*** | (2006.01) |
| ***A43B 23/00*** | (2006.01) |
| ***A43B 1/10*** | (2006.01) |
| ***A43B 5/02*** | (2006.01) |

(52) U.S. Cl.

USPC ..... 36/103; 36/30 R; 36/128; 36/102

(58) Field of Classification Search

USPC ..... 36/91, 102, 103, 59 C, 8.3, 43, 44, 30 R, 36/31, 145, 126–129, 107, 108, 76 R, 155

See application file for complete search history.

(56) References Cited

U.S. PATENT DOCUMENTS

| | | | | |
|---|---|---|---|---|
| 3,650,051 | A | | 3/1972 | Sass |
| 3,703,775 | A | | 11/1972 | Gatti |
| 4,161,828 | A | * | 7/1979 | Benseler et al. ..... 36/32 R |
| 4,255,877 | A | | 3/1981 | Bowerman |
| 4,316,334 | A | | 2/1982 | Hunt |
| 4,454,662 | A | | 6/1984 | Stubblefield |
| 4,507,879 | A | | 4/1985 | Dassler |
| 4,553,342 | A | | 11/1985 | Derderian et al. |
| 4,571,852 | A | * | 2/1986 | Lamarche et al. ..... 36/32 R |
| 4,654,915 | A | | 4/1987 | Rigon |
| 4,654,983 | A | | 4/1987 | Graham et al. |
| 4,787,156 | A | | 11/1988 | Bade |
| 4,821,430 | A | | 4/1989 | Flemming et al. |
| 4,852,274 | A | * | 8/1989 | Wilson ..... 36/29 |
| 4,879,821 | A | | 11/1989 | Graham et al. |
| 4,899,470 | A | | 2/1990 | Holland, III |
| 4,972,613 | A | | 11/1990 | Loveder |
| 5,012,597 | A | | 5/1991 | Thomasson |

(Continued)

FOREIGN PATENT DOCUMENTS

| | | |
|---|---|---|
| WO | WO 93/05673 | 4/1993 |

OTHER PUBLICATIONS

Notification Concerning Transmittal of International Preliminary Report on Patentability mailed Dec. 16, 2010 in PCT Application No. PCT/US2009/045922.

(Continued)

*Primary Examiner* — Jila M Mohandesi
*Assistant Examiner* — Tiffany Drake
(74) *Attorney, Agent, or Firm* — Plumsea Law Group, LLC

(57) ABSTRACT

An article of footwear with flexing portions disposed in an arch portion of a sole system is disclosed. The flexing portions in the sole system increase the curling toe flexibility of the article of footwear. In addition, the sole system includes trapping portions that enhance the ability of a wearer to stop and capture a ball. Furthermore, the article of footwear includes an asymmetric fastening system biased toward a medial side of the article.

30 Claims, 27 Drawing Sheets

(56) References Cited

U.S. PATENT DOCUMENTS

| | | | | |
|---|---|---|---|---|
| 5,142,797 | A | 9/1992 | Cole, III | |
| 5,203,097 | A | 4/1993 | Blair | |
| 5,437,112 | A | 8/1995 | Johnston | |
| 5,461,801 | A | 10/1995 | Anderton | |
| D381,495 | S | 7/1997 | Avar | |
| 5,669,161 | A | 9/1997 | Huang | |
| 5,761,832 | A * | 6/1998 | George | 36/59 C |
| D403,495 | S | 1/1999 | Sorofman | |
| 5,915,820 | A | 6/1999 | Kraeuter et al. | |
| 5,970,631 | A | 10/1999 | Inman | |
| 6,119,373 | A * | 9/2000 | Gebhard et al. | 36/114 |
| 6,345,455 | B1 * | 2/2002 | Greer et al. | 36/155 |
| 6,393,736 | B1 * | 5/2002 | Greer et al. | 36/155 |
| 6,748,675 | B2 | 6/2004 | Sato | |
| 6,757,991 | B2 | 7/2004 | Sussmann | |
| 6,918,198 | B2 * | 7/2005 | Chi | 36/29 |
| 6,971,192 | B2 | 12/2005 | Shepherd | |
| 6,973,746 | B2 | 12/2005 | Auger et al. | |
| 6,990,755 | B2 * | 1/2006 | Hatfield et al. | 36/97 |
| 7,168,190 | B1 * | 1/2007 | Gillespie | 36/102 |
| 7,203,985 | B2 | 4/2007 | Cox et al. | |
| 7,591,085 | B2 * | 9/2009 | Haugltn | 36/117.3 |
| 2003/0167658 | A1 | 9/2003 | Davis | |
| 2003/0196354 | A1 | 10/2003 | Chu | |
| 2004/0055183 | A1 | 3/2004 | Lee et al. | |
| 2006/0150442 | A1 | 7/2006 | Auger et al. | |
| 2006/0196088 | A1 | 9/2006 | Forse | |
| 2006/0283043 | A1 * | 12/2006 | Lamstein | 36/3 B |
| 2006/0283049 | A1 | 12/2006 | Huseby | |
| 2007/0033834 | A1 | 2/2007 | Cheskin et al. | |
| 2007/0107265 | A1 * | 5/2007 | Mueller et al. | 36/91 |
| 2008/0005930 | A1 | 1/2008 | Skirrow | |

OTHER PUBLICATIONS

International Search Report and Written Opinion from PCT Application No. PCT/US2009/45922 mailed Oct. 28, 2009.

* cited by examiner

ARTICLE OF FOOTWEAR FOR SOCCER

BACKGROUND OF THE INVENTION

1. Field of the Invention

The present invention relates to an article of footwear, and in particular to an article of footwear configured for indoor soccer.

2. Description of Related Art

Articles of footwear with provisions for increasing flexibility in the sole have been previously proposed. Bade (U.S. Pat. No. 4,787,156) teaches sections of a sole that may be separated by a plurality of zones. The zones can be formed of material of the intermediate sole. Bade teaches that by varying the dimensions of the sole sections, their separations and the lengths and widths of the zones, as well as by appropriate selection of the properties of the materials for the intermediate sole and the sections of the outer sole, it is possible to adapt the flexibility in the sole.

The Bade design lacks provisions for twisting at the arch of the sole, as well as for different degrees of bending on a medial and lateral side of the sole.

SUMMARY OF THE INVENTION

The invention discloses an article of footwear with flexing article of footwear, comprising: an upper including a medial portion, a lateral portion and an intermediate portion disposed between the medial portion and the lateral portion; a lacing portion configured to tighten the upper; the lacing portion including a first end portion disposed adjacent to an entry hole of the upper; the lacing portion including a second end portion disposed adjacent to a toe portion of the upper; and where the first end portion is disposed in the intermediate portion and where the second end portion is disposed in the medial portion.

In another aspect, the upper includes a pad on the lateral portion.

In another aspect, the upper is associated with a sole system.

In another aspect, the sole system includes a first flexing portion and a second flexing portion that are disposed in an arch portion of the sole system and wherein the first flexing portion is separated from the second flexing portion in a lateral direction by an intermediate portion.

In another aspect, the first flexing portion is configured to bend independently of the second flexing portion.

In another aspect, the invention provides an article of footwear, comprising: a sole system comprising a first flexing portion and a second flexing portion; an intermediate portion disposed between the first flexing portion and the second flexing portion in a lateral direction; the first flexing portion being more flexible than the intermediate portion and the second flexing portion being more flexible than the intermediate portion; and where the first flexing portion can flex independently of the second flexing portion.

In another aspect, the first flexing portion and the second flexing portion are disposed in an arch portion of the sole system.

In another aspect, the first flexing portion and the second flexing portion comprise a plurality of slots.

In another aspect, the slots are filled with a material that has a different rigidity than the first flexing portion and the second flexing portion.

In another aspect, the first flexing portion is more rigid than the second flexing portion.

In another aspect, the sole system is associated with an upper that comprises an asymmetric lacing portion.

In another aspect, the sole system includes a trapping portion configured to trap a ball.

In another aspect, the invention provides an article of footwear, comprising: a sole system comprising a peripheral toe portion configured to contact a ground surface and a central trapping portion bounded by the peripheral toe portion and configured to contact a ball; the peripheral toe portion having a first coefficient of friction and the central trapping portion having a second coefficient of friction; and where the second coefficient of friction is greater than the first coefficient of friction.

In another aspect, the sole system includes a plurality of trapping portions.

In another aspect, the sole system includes a first trapping portion set disposed on a periphery of the sole system.

In another aspect, the sole system includes a second trapping portion set disposed throughout the sole system.

In another aspect, the sole system includes a first flexing portion and a second flexing portion disposed on an arch portion.

In another aspect, the first flexing portion is separated from the second flexing portion in a lateral direction by an intermediate portion.

In another aspect, the first flexing portion is configured to bend differently from the second flexing portion.

In another aspect, the invention provides an article of footwear, comprising: a sole including a front portion; a toe bumper disposed on the front portion, the toe bumper being configured to contact a ball; and where the toe bumper has an asymmetric shape.

In another aspect, the toe bumper includes a protrusion disposed adjacent to a big toe of a wearer when the article of footwear is worn.

In another aspect, the toe bumper includes a standard curved portion and a flattened curved portion.

In another aspect, the standard curved portion is disposed on a lateral side of the sole and wherein the flattened curved portion is disposed on a medial side of the sole.

In another aspect, the asymmetric shape of the toe bumper is configured to increase the surface area of the front portion.

In another aspect, the toe bumper includes a textured surface.

In another aspect, the invention provides an article of footwear, comprising: a sole including a heel portion; a heel bumper disposed on the heel portion, wherein the heel bumper is configured to contact a ball; and where the heel bumper has an asymmetric shape.

In another aspect, the heel portion includes a rearward portion disposed between a medial portion and a lateral portion of the sole system.

In another aspect, the heel bumper includes a rearward edge disposed in the rearward portion.

In another aspect, the heel bumper has an approximately triangular shape.

In another aspect, the heel bumper includes a textured surface.

In another aspect, the invention provides an article of footwear, comprising: a sole system; an arch portion a medial portion and a lateral portion; the arch portion including at least one slot portion; the slot portion having a wide portion open to the medial portion and the slot portion having a narrow portion disposed on the lateral portion; and where the at least one slot portion provides flexibility to the arch portion.

In another aspect, the at least one slot portion is configured to accommodate twisting of the arch portion.

In another aspect, the arch portion includes at least two slot portions.

In another aspect, the at least one slot portion is formed by removing a portion of the sole system from the arch portion.

In another aspect, the at least one slot portion is approximately V-shaped.

In another aspect, the invention provides an article of footwear, comprising: a sole system including an arch portion with at least one slot portion; an insole including an arch portion with at least one groove; and where the at least one slot portion is disposed adjacent to the at least one groove when the insole is inserted into the article of footwear and where the at least one slot portion is configured to cooperate with the at least one groove to facilitate flexibility of the sole system and the insole.

In another aspect, the arch portion of the sole system includes at least two slot portions.

In another aspect, the arch portion of the insole includes at least two grooves.

In another aspect, the sole system includes a forefoot portion with at least one flexing groove.

In another aspect, the insole includes a forefoot portion with at least one groove.

In another aspect, the at least one flexing groove of the sole system corresponds with the at least one groove of the forefoot portion of the insole.

In another aspect, the invention provides an article of footwear, comprising: a sole system comprising a peripheral toe portion configured to contact a ground surface and a central trapping portion bounded by the peripheral toe portion and configured to contact a ball; and where the central trapping portion is recessed with respect to the peripheral toe portion.

In another aspect, the central trapping portion has a concave shape.

In another aspect, the central trapping portion has an inward dome-like shape.

In another aspect, the central trapping portion is configured with a shape that conforms to a contour of a ball.

In another aspect, the invention provides an article of footwear, comprising: an upper including a lacing portion; the lacing portion including a cut out portion with a first side and a second side; the lacing portion including a stretching portion connected to the first side and the second side; and where the stretching portion is configured to stretch and provide flexibility to the upper.

In another aspect, the stretching portion is made of elastic.

In another aspect, the lacing portion includes at least two cut out portions and wherein the at least two cut out portions are associated with two stretching portions.

In another aspect, the upper is associated with a sole system that is configured to flex.

In another aspect, the stretching portion allows the upper to flex in a manner that cooperates with the flexing of the sole system.

Other systems, methods, features and advantages of the invention will be, or will become apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION OF THE PREFERRED EMBODIMENTS

Figure 1:
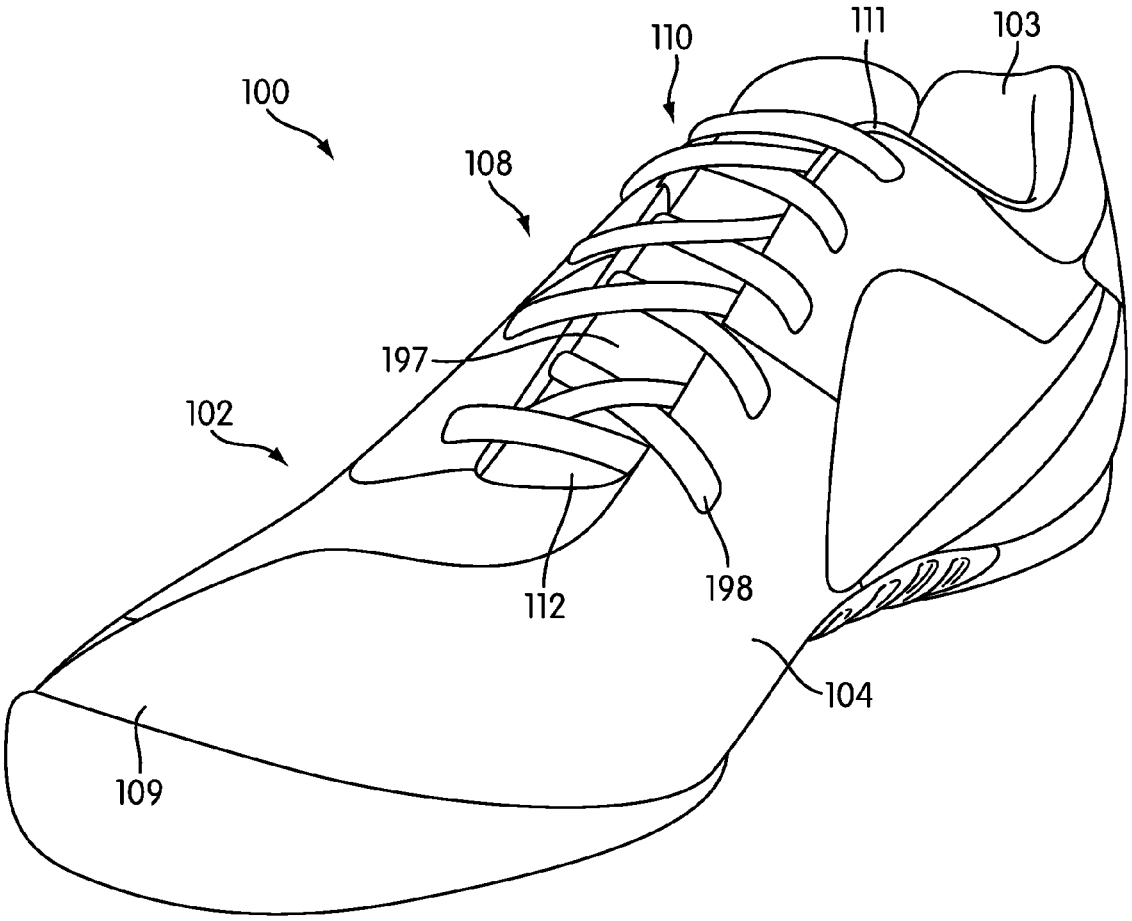
FIG. 1 is an isometric view of a preferred embodiment of an article of footwear.
Figure 2:
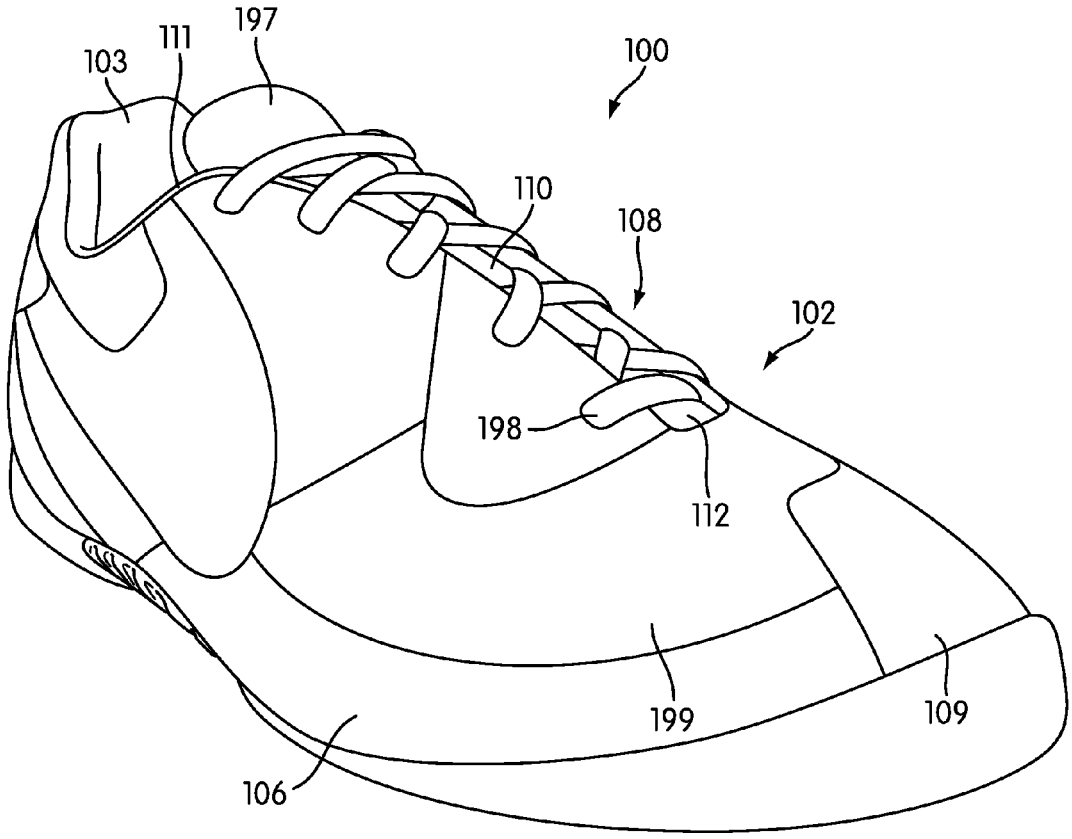
FIG. 2 is an isometric view of a preferred embodiment of an article of footwear.

FIGS. 1-2 illustrate a preferred embodiment of article of footwear 100. For clarity, the following detailed description discusses a preferred embodiment, in the form of an indoor soccer shoe, but it should be noted that the present invention could take the form of any article of footwear including, but not limited to, outdoor soccer shoes, football shoes, rugby shoes, baseball shoes as well as other kinds of shoes. As shown in FIG. 1, article of footwear 100, also referred to simply as article 100, is intended to be used with a right foot; however, it should be understood that the following discussion may equally apply to a mirror image of article of footwear 100 that is intended for use with a left foot.

Article of footwear 100 preferably includes upper 102. Generally, upper 102 may be any type of upper. In particular, upper 102 could have any design, shape, size and/or color. Preferably, upper 102 is configured to receive a wearer's foot. In this preferred embodiment, upper 102 includes entry hole 103 configured to receive a foot of a wearer.

Referring to FIG. 1, upper 102 includes medial portion 104. Also, upper 102 includes lateral portion 106 disposed opposite of medial portion 104 as seen in FIG. 2. Furthermore, upper 102 includes intermediate portion 108 disposed between medial portion 104 and lateral portion 106. Preferably, intermediate portion 108 corresponds to the instep or vamp of upper 102. In a preferred embodiment, intermediate portion 108 may partially coincide with tongue 197 of upper 102.

In some cases, portions of upper 102 may include one or more pads. Generally, one or more pads may absorb an impact from contact with other objects, including, but not limited to, balls and ground surfaces. A pad could be disposed on any portion of upper 102. In some embodiments, one or more pads could be associated with medial portion 104. In other embodiments, one or more pads could be associated with intermediate portion 108. In a preferred embodiment, one or more pads could be associated with lateral portion 106.

Referring to FIG. 2, lateral portion 106 includes pad 199. In some embodiments, pad 199 may extend over an entire length of lateral portion 106. In a preferred embodiment, pad 199 may extend over a lateral side of toe portion 109 of upper 102. With this arrangement, pad 199 may be configured to absorb impacts from a ball during some types of passing.

In some embodiments, article of footwear 100 may include a fastening system configured to tighten upper 102. Generally, article of footwear 100 could be associated with any type of fastening system including, but not limited to laces, straps, zippers, hook and loop fasteners, as well as other types of fastening systems. In a preferred embodiment, article of footwear 100 may include a lacing system.

Figure 3:
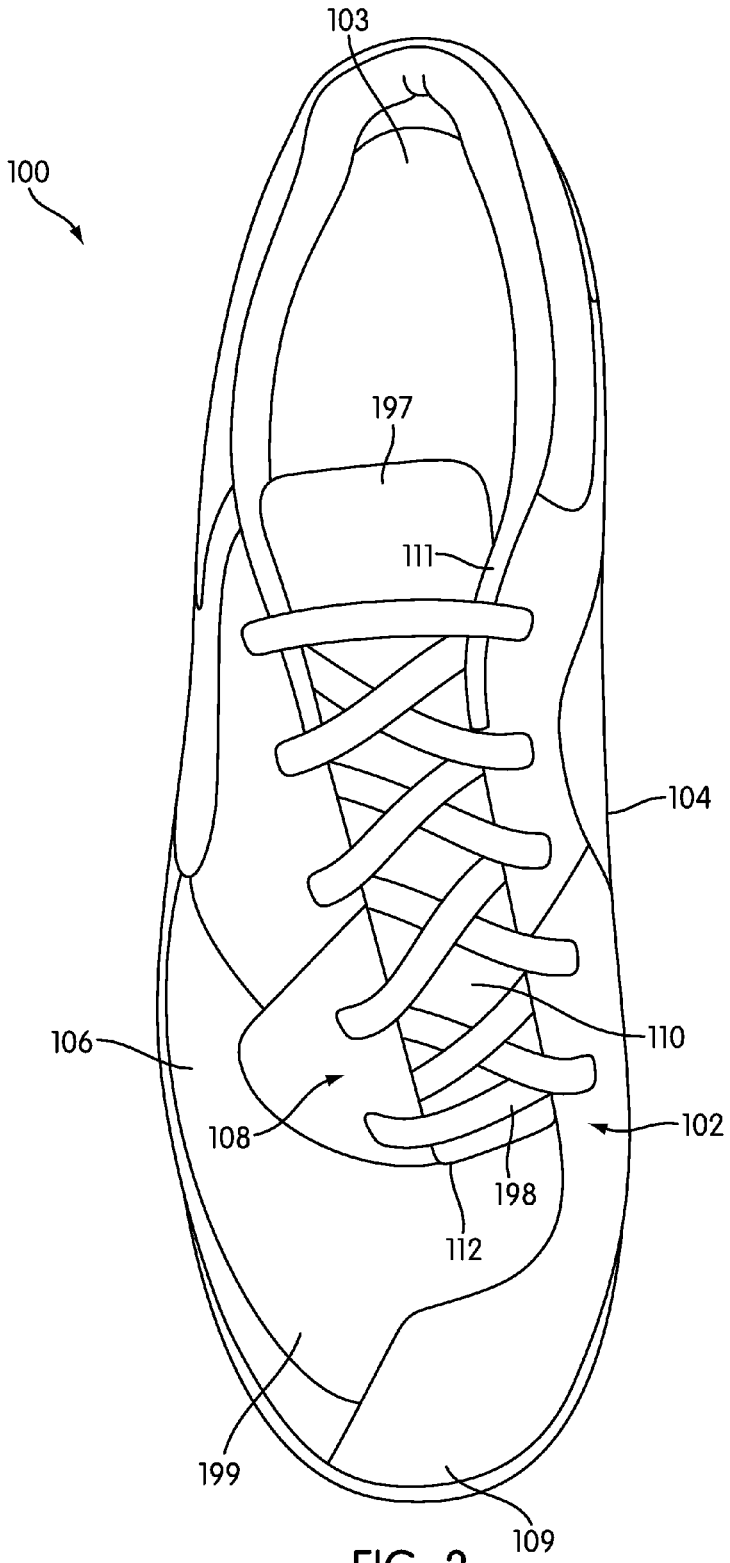
FIG. 3 is a top view of a preferred embodiment of an article of footwear.

Referring to FIGS. 1-3, article 100 includes lace 198 that may be used to tighten upper 102. Preferably, lace 198 is disposed over tongue 197 in lacing portion 110 of upper 102. Lacing portion 110 is configured with first end portion 111 and second end portion 112. First end portion 111 may be disposed adjacent to entry hole 103. Similarly, second end portion 112 may be disposed adjacent to toe portion 109. With this arrangement, lace 198 may tighten lacing portion 110 to secure a foot within upper 102.

Generally, lacing portion 110 may be disposed in any manner on upper 102. In some embodiments, lacing portion 110 may be disposed symmetrically on intermediate portion 108. In a preferred embodiment, lacing portion 110 may be disposed asymmetrically on upper 102. The term "asymmetric" as used throughout this detailed description and in the claims refers to any arrangement of a lacing portion where the lacing portion does not extend symmetrically over the medial portion and the lateral portion of an upper.

Preferably, an asymmetric fastening system may provide greater comfort and a better fit for a wearer. In some cases, a fastening system may be configured with an asymmetrical bias to a lateral portion of an upper. Typically, outdoor soccer players kick the ball on a medial portion of a toe portion. By positioning a fastening system on a lateral portion, the fastening system preferably does not interfere with the power of a kick for an outdoor soccer player. However, indoor soccer players may rely more on finesse than power. In particular, indoor soccer players often use a lateral portion of a toe portion to make short and medium distance passes. For example, a short distance pass made with the lateral portion of the toe portion is often used in a "give and go" passing situation. In a preferred embodiment, a fastening system may be configured with an asymmetrical bias to a medial portion of an upper. Preferably, this asymmetrical bias to the medial portion helps prevent interference between the lacing portion and a ball during finesse passing.

In this embodiment, lacing portion 110 is configured with an asymmetrical bias to medial portion 104. In particular, first end portion 111 of lacing portion 110 is disposed in intermediate portion 108. Furthermore, second end portion 112 is disposed in medial portion 104. With this arrangement, the asymmetrical bias to medial portion 104 preferably provides a better fit that contributes to the finesse capabilities of a wearer of article 100.

For purposes of clarity, only some portions of upper 102 are discussed in this embodiment. It should be understood that upper 102 may include other provisions that are known in the art for assisting in running, kicking or other athletic maneuvers.

Preferably, an article of footwear configured for soccer includes provisions to enhance the trapping abilities of a wearer. During trapping, a wearer of the article of footwear may stop a ball on a toe portion of an article. The wearer of the article may then curl the toe portion of the article to capture the ball between the article and a ground surface. In some embodiments, a flexible material may be used in a sole of an article of footwear to allow a wearer to curl the toe portion of the article. In a preferred embodiment, a sole of an article of footwear may include flexible portions configured to allow a toe portion of a sole to curl.

Figure 4:
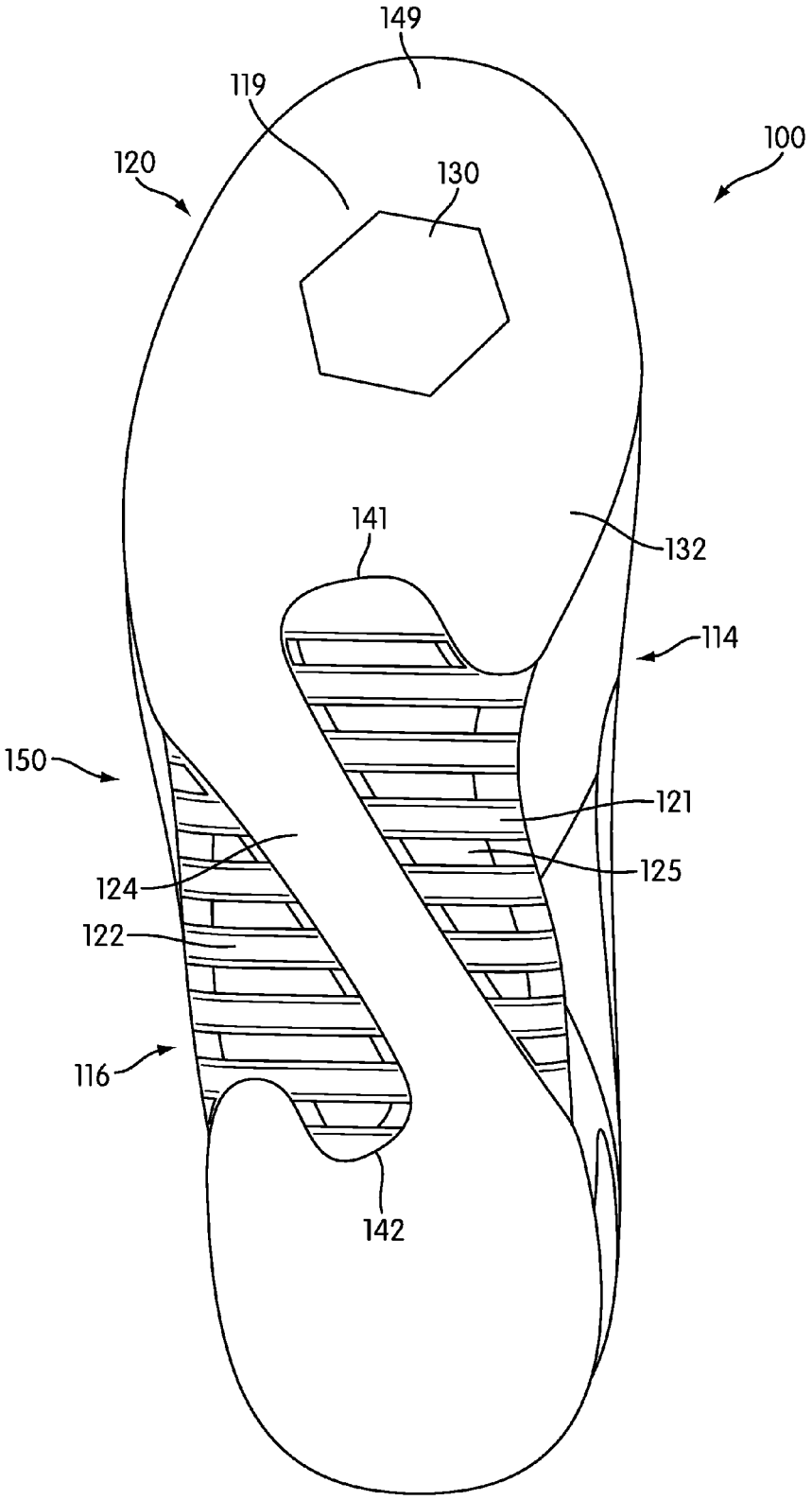
FIG. 4 is a plan view of a preferred embodiment of a bottom surface of a sole system of an article of footwear.

In the current embodiment, upper 102 is associated with sole system 120. Referring to FIG. 4, sole system 120 includes bottom surface 132. Bottom surface 132 is preferably configured to contact a ground surface, including, but not limited to natural grass or synthetic grass. For the purposes of illustration, the top surface of sole system 120 is not shown in these Figures. Furthermore, in some cases, sole system 120 may include a midsole and/or insole, as well as provisions for traction including, but not limited to cleats and traction elements, that are not illustrated in these Figures for purposes of clarity.

In order to increase the flexibility of article 100, sole system 120 includes two flexing portions. In other embodiments, sole system 120 may include more or less flexing portions. In this embodiment, sole system 120 includes first flexing portion 121 and second flexing portion 122. Preferably, first flexing portion 121 and second flexing portion 122 are disposed in arch portion 150 of sole system 120. In particular, first flexing portion 121 is disposed on medial portion 114 of sole system 120. Likewise, second flexing portion 122 is disposed on lateral portion 116, opposite of medial portion 114, of sole system 120.

In some embodiments, first flexing portion 121 may be separated from second flexing portion 122. In this embodiment, first flexing portion 121 and second flexing portion 122 are separated in a lateral direction by intermediate portion 124 on bottom surface 132. In other embodiments, first flexing portion 121 and second flexing portion 122 may be disposed adjacent to one another.

Although first flexing portion 121 and second flexing portion 122 are disposed in arch portion 150 in the current embodiment, in other embodiments, first flexing portion 121 and second flexing portion 122 could be located in other portions of sole system 120. For example, in another embodiment, first flexing portion 121 and/or second flexing portion 122 could be disposed in toe portion 119 of sole system 120. In still another embodiment, first flexing portion 121 and/or second flexing portion 122 could be disposed in a heel portion of sole system 120.

Generally, first flexing portion 121 and second flexing portion 122 may be configured with any shapes and sizes. In this embodiment, first flexing portion 121 and second flexing portion 122 have substantially similar shapes and sizes. In particular, first flexing portion 121 and second flexing portion 122 have a rounded triangular shape with prominent lobes. Specifically, first flexing portion 121 includes first lobe 141. Similarly, second flexing portion 122 includes second lobe 142. Although second lobe 142 is similar to first lobe 141, second lobe 142 is smaller than first lobe 141. In addition, first flexing portion 121 and second flexing portion 122 are inverted with respect to each other. In other words, first lobe 141 is directed toward toe portion 119 while second lobe 142 faces rearward toward a heel portion of article 100. This arrangement preferably facilitates the curling of toe portion 119 of sole system 120. By providing a means of curling toe portion 119, the finesse abilities of a wearer may be enhanced.

Preferably, first flexing portion 121 and second flexing portion 122 include slots 125. Generally, first flexing portion 121 and second flexing portion 122 may include any number of slots. In some embodiments, first flexing portion 121 and second flexing portion 122 may each include a single slot. In other embodiments, first flexing portion 121 and second flexing portion 122 may include multiple slots. In a preferred embodiment, first flexing portion 121 includes seven slots and second flexing portion 122 includes six slots.

Generally, slots 125 may extend in any direction. In this embodiment, slots 125 may extend in a generally lateral direction. The term "lateral direction" as used throughout this detailed description and in the claims refers to a direction running between a medial portion and a lateral portion of an article of footwear. In other embodiments, however, slots 125 could extend in a longitudinal direction. The term "longitudinal direction" as used throughout this detailed description and in the claims refers to a direction that is perpendicular to the lateral direction. In other words, the longitudinal direction may run between a toe portion and a heel portion of an article of footwear. In still other embodiments, slots 125 could extend in a diagonal direction that is between a lateral direction and a longitudinal direction.

First flexing portion 121 and second flexing portion 122 may be formed in any manner known in the art. In this embodiment, first flexing portion 121 and second flexing portion 122 may be formed by removing at least a portion of sole system 120. Specifically, material may be removed from first flexing portion 121 and second flexing portion 122 to create slots 125. In some embodiments, slots 125 may be filled with a material with a different rigidity than first flexing portion 121 and second flexing portion 122. In some cases, slots 125 may be filled with a more flexible material than first flexing portion 121 and second flexing portion 122. This arrangement may allow slots 125 to compress when a wearer arches article 100 to curl toe portion 119 of sole system 120. In other embodiments, slots 125 may remain hollow. Preferably, slots 125 decrease the rigidity of sole system 120 to provide greater flexibility to sole system 120. With this preferred configuration, slots 125 enable a wearer to bend article 100 with greater ease.

Preferably, first flexing portion 121 and second flexing portion 122 are more flexible than intermediate portion 124. Furthermore, first flexing portion 121 and second flexing portion 122 may be configured to bend independently. For example, in some cases, first flexing portion 121 may be bent more than second flexing portion 122. This difference in the bending of first flexing portion 121 and second flexing portion 122 produces greater curvature in medial portion 114 than lateral portion 116. Likewise, in other cases, second flexing portion 122 may be bent more than first flexing portion 121 to produce greater curvature in lateral portion 116 than medial portion 114. With this arrangement, sole system 120 may accommodate bending, curling and twisting. This preferred arrangement gives greater control to a wearer of article 100 for finesse maneuvers.

Generally, sole system 120 may be constructed of multiple materials. In some embodiments, bottom surface 132 may be constructed of materials typically used for an outsole including, but not limited to elastomers, siloxanes, natural rubber, synthetic rubbers, natural leather, synthetic leather, or plastics. In some cases, first flexing portion 121, intermediate portion 124 and second flexing portion 122 may be constructed of the same material as bottom surface 132. In other embodiments, intermediate portion 124 may be constructed from the same material as bottom surface 132. In addition, first flexing portion 121 and second flexing portion 122 may be constructed with different materials to fine tune the flexing properties of arch portion 150. For example, first flexing portion 121 may be constructed of a material that is more rigid than the material comprising second flexing portion 122. In a preferred embodiment, first flexing portion 121 and second flexing portion 122 may be constructed of a material that is softer and more flexible than conventional material for an outsole. In addition, intermediate portion 124 may comprise conventional material for an outsole. With this preferred arrangement, the flexibility of first flexing portion 121 and second flexing portion 122 in arch portion 150 may be increased to allow article 100 to trap a soccer ball.

Typically, during trapping, a soccer ball may be first received at toe portion 119 of sole system 120. In some cases, toe portion 119 may include provisions for gripping the ball. In a preferred embodiment, toe portion 119 may include a central trapping portion that has a high coefficient of friction for gripping a ball.

In some embodiments, toe portion 119 of sole system 120 may comprise peripheral toe portion 149 and central trapping portion 130. Preferably, peripheral toe portion 149 bounds central trapping portion 130 and extends to the edges of toe portion 119. In this manner, peripheral toe portion 149 may be configured to contact a ground surface while central trapping portion 130 is configured to contact a ball. Preferably, central trapping portion 130 enhances the ability of a wearer to stop and capture the ball in central trapping portion 130.

In some embodiments, peripheral toe portion 149 may be associated with a first coefficient of friction. Likewise, central trapping portion 130 may be associated with a second coefficient of friction. In a preferred embodiment, the second coefficient of friction is greater than the first coefficient of friction. With this arrangement, central trapping portion 130 may be "stickier" than peripheral toe portion 149 to trap a soccer ball.

In order to assist a wearer in trapping a ball, central trapping portion 130 may be configured in any shape and with any size. Examples of various shapes include, but are not limited to, hexagons, squares, rectangles, circles, ovals, polygonal and irregular shapes, as well as any other type of shape. Additionally, central trapping portion 130 may protrude various heights from bottom surface 132. By using different shapes protruding with different heights, trapping portion 130 may be configured to engage and trap a soccer ball.

In this embodiment, central trapping portion 130 is shaped substantially similar to a panel of a soccer ball with a hexagonal shape. The hexagonal shape of central trapping portion 130 is smaller than a panel of a soccer ball. In other embodiments, the hexagonal shape of central trapping portion 130 may be the same size as a panel of a soccer ball. In addition, central trapping portion 130 is generally flush with bottom surface 132. With this configuration, central trapping portion 130 preferably facilitates the trapping of a soccer ball.

Figure 5:
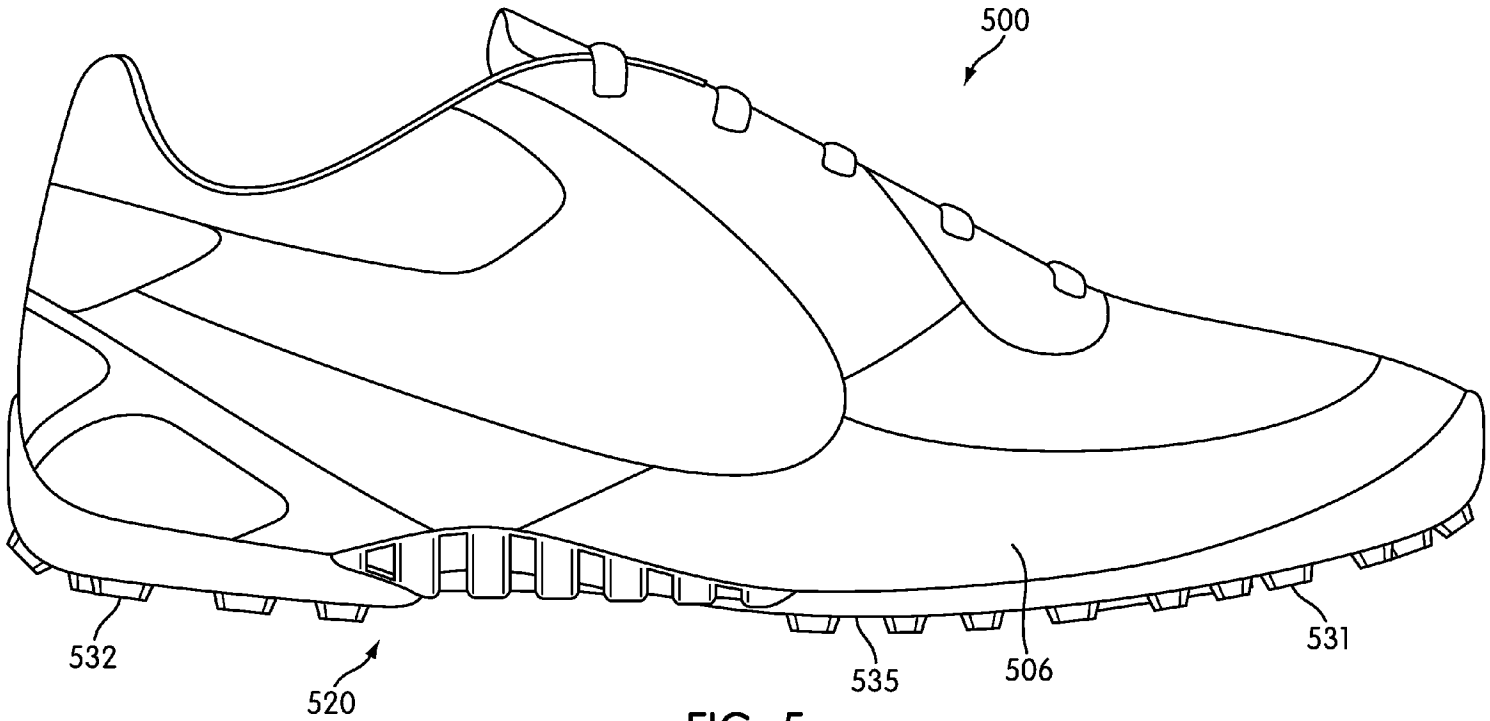
FIG. 5 is a side view of an alternative embodiment of an article of footwear.
Figure 6:
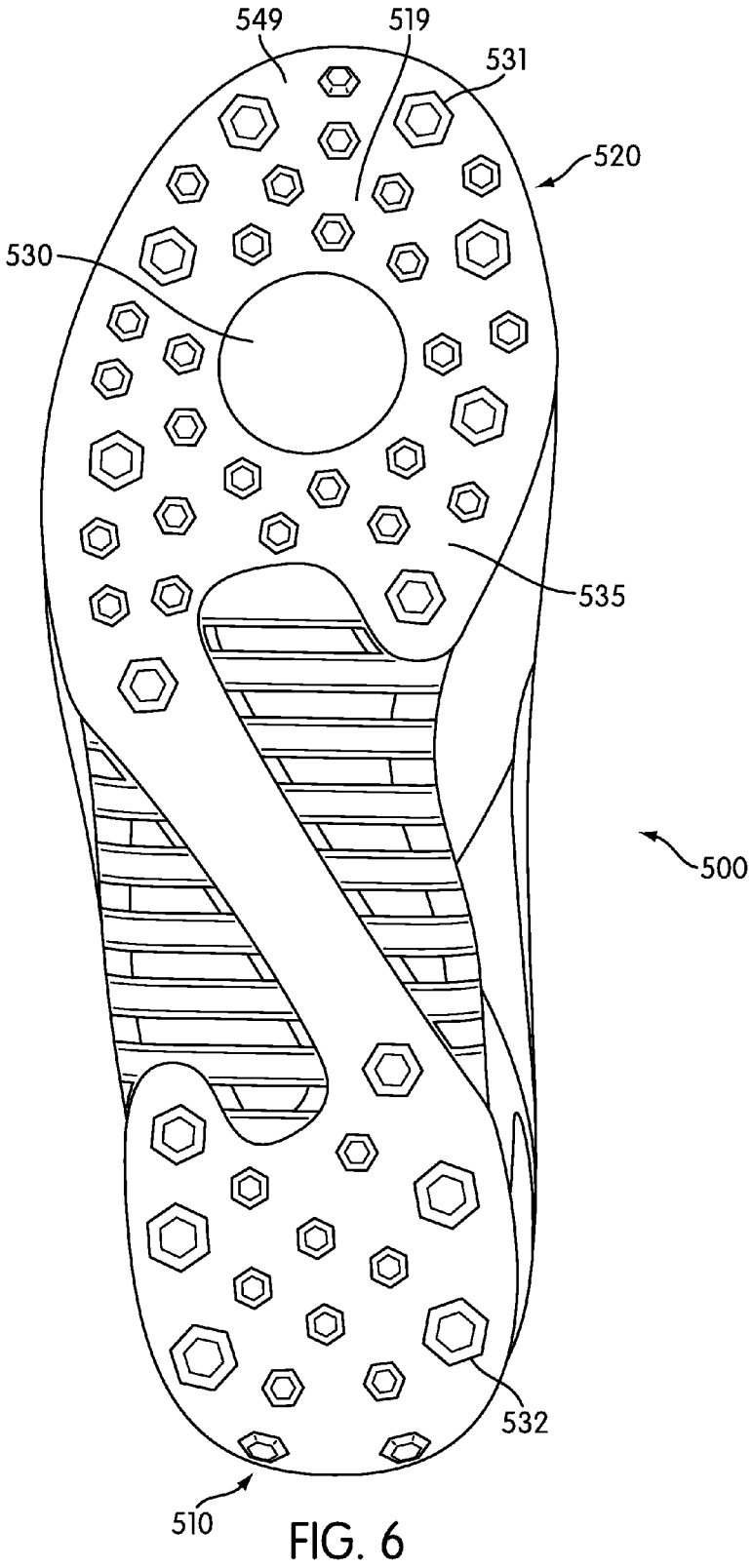
FIG. 6 is a plan view of an alternative embodiment of a bottom surface of a sole system of an article of footwear.

In some embodiments, a sole system may utilize a plurality of trapping portions to increase the trapping abilities of a wearer. FIGS. 5-6 are illustrations of an alternative embodiment of article of footwear 500 with multiple trapping portions. In particular, FIG. 5 provides a side view of lateral portion 506 of article of footwear 500. Furthermore, FIG. 6 provides a view of sole system 520 of article 500. In this alternative embodiment, article of footwear 500 is substantially similar to article of footwear 100 of the previous embodiment. However, in this embodiment, multiple trapping portions are disposed on sole system 520. Preferably, this configuration enhances the trapping abilities of a wearer.

Referring to FIG. 6, bottom surface 535 of sole system 520 includes central trapping portion 530. In particular, central trapping portion 530 is disposed in toe portion 519 of sole system 520. Furthermore, central trapping portion 530 is bounded by peripheral toe portion 549 in a manner substantially similar to the previous embodiment. As previously discussed, trapping portions may include any shape. In this embodiment, central trapping portion 530 is configured with a generally circular shape.

Furthermore, sole system 520 includes first trapping portion set 531 and second trapping portion set 532. Generally, first trapping portion set 531 includes a plurality of trapping portions disposed on peripheral portion 550 of sole system 520. Likewise, second trapping portion set 532 includes a plurality of trapping portions that are disposed throughout toe portion 519 and heel portion 510 of sole system 520.

Generally, first trapping portion set 531 and second trapping portion set 532 may include any number of trapping portions. Furthermore, first trapping portion set 531 and second trapping portion set 532 may be associated with any sizes. For example, in this preferred embodiment, first trapping portion set 531 is associated with trapping portions that are larger than the trapping portions of second trapping portion set 532. With this arrangement, first trapping portion set 531 may provide primary contact with a ball or ground surface. In other embodiments, however, the trapping portions of first trapping portion set 531 and second trapping portion set 532 could have substantially similar sizes.

In this embodiment, first trapping portion set 531 and second trapping portion set 532 are smaller than central trapping portion 530. In particular, first trapping portion set 531 and second trapping portion set 532 are configured with generally hexagonal shapes. In other embodiments, first trapping portion set 531 and second trapping portion set 532 could be configured with any other shapes, including, but not limited to hexagons, squares, rectangles, circles, ovals, polygonal and irregular shapes, as well as any other type of shape. Preferably, this arrangement of first trapping portion set 531 and second trapping portion set 532 provide increased opportunities for a wearer to trap a ball at toe portion 549 and heel portion 510.

Generally, bottom surface 535 of sole system 520 may be associated with a first coefficient of friction. Furthermore, central trapping portion 530 may be associated with a second coefficient of friction that is greater than the first coefficient of friction. Preferably, this arrangement enhances the trapping capabilities of central trapping portion 530. In some embodiments, first trapping portion set 531 and second trapping portion set 532 may be associated with a coefficient of friction substantially similar to the second coefficient of friction. In other embodiments, central trapping portion 530, first trapping portion set 531 and second trapping portion set 532 may be configured with different coefficients of friction. By manipulating the frictional properties of central trapping portion 530, first trapping portion set 531 and second trapping portion set 532, the trapping capabilities of article of footwear 500 may be fine tuned.

Preferably, central trapping portion 530, first trapping portion set 531 and second trapping portion set 532 are made of materials substantially similar to the materials discussed in the previous embodiment for central trapping portion 130. In some cases, different materials can be used for central trapping portion 530, first trapping portion set 531 and second trapping portion set 532 in order to adjust the individual frictional properties of each set of trapping portions.

Referring to FIG. 5, first trapping portion set 531 and second trapping portion set 532 may protrude a distance from bottom surface 535 in a similar manner to cleats. By protruding from bottom surface 535, first trapping portion set 531 and second trapping portion set 532 may increase the chances of article 500 stopping and trapping a soccer ball. In some cases, first trapping portion set 531 and second trapping portion set 532 may also be configured to function as low profile cleats for some ground surfaces.

Figure 7:
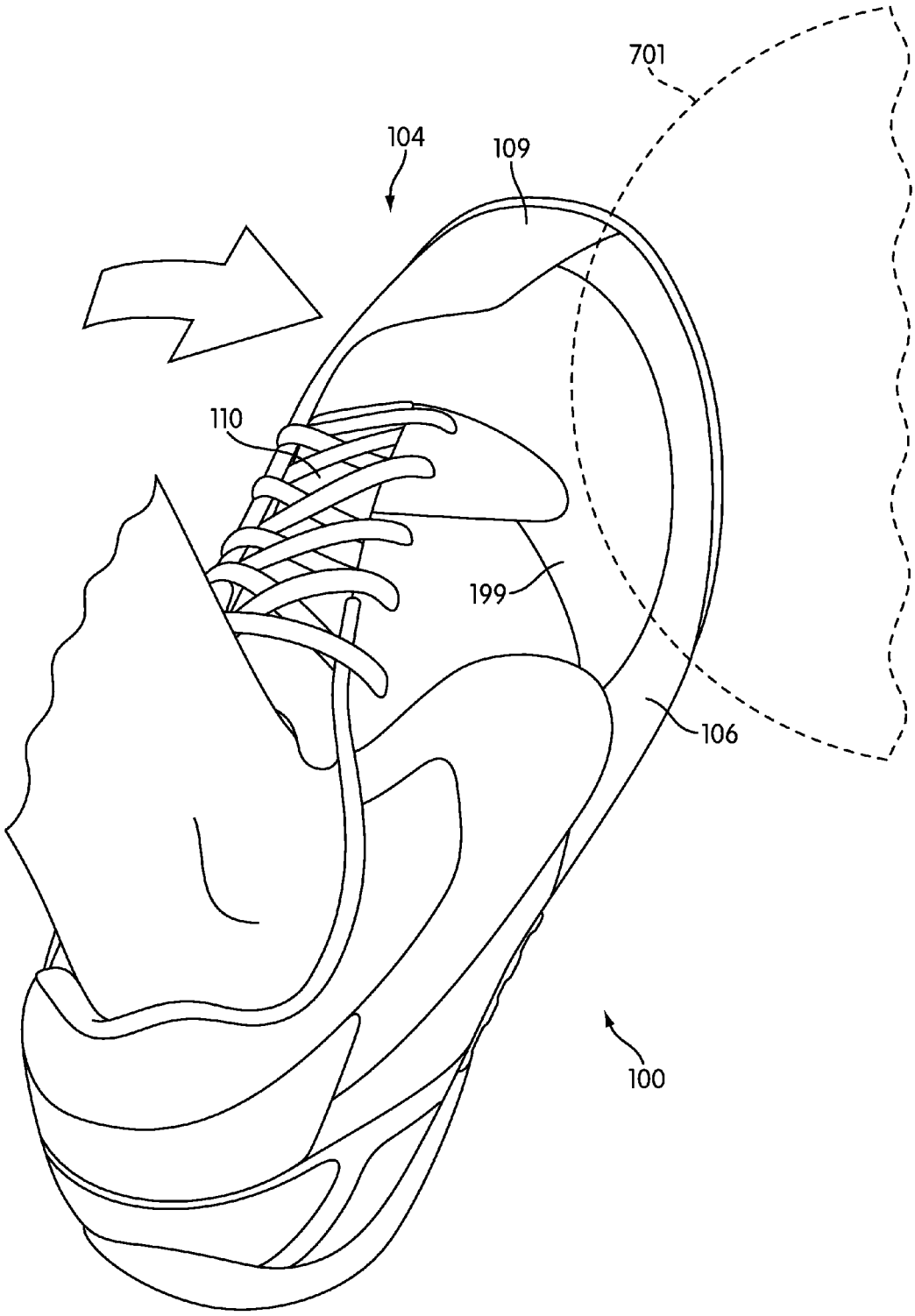
FIG. 7 is an isometric view of an exemplary embodiment of a wearer of an article of footwear passing a soccer ball.

As discussed with respect to FIGS. 1-3, the asymmetric bias of lacing portion 110 preferably allows a soccer player to easily pass a ball using lateral portion 106 of toe portion 109 without interference from lacing portion 110. FIG. 7 is an isometric view of an exemplary embodiment of a wearer of article 100 passing soccer ball 701. It should be understood that this embodiment is intended to be exemplary. In other embodiments, article 100 may contact soccer ball 701 in another manner in order to pass soccer ball 701.

Typically, a wearer will pass or strike the soccer ball with lateral portion 106 of toe portion 109 of article of footwear 100. In this embodiment, lacing portion 110 does not contact soccer ball 701 when lateral portion 106 of toe portion 109 contacts soccer ball 701 in order to pass soccer ball 701. Preferably, this configuration of lacing portion 110 with an asymmetrical bias to medial portion 104 does not interfere with the passing of soccer ball 701 using lateral portion 106.

As previously discussed, article 100 includes pad 199 disposed on lateral portion 106 of toe portion 109. When lateral portion 106 of toe portion 109 contacts soccer ball 701 in order to pass soccer ball 701, pad 199 may absorb some of the impact of soccer ball 701. With this arrangement, pad 199 may assist a wearer when passing or striking soccer ball 701 by buffering some of the force of the pass or strike of soccer ball 701. In addition, pad 199 provides a firm surface to contact soccer ball 701 when passing or striking with lateral portion 106 of toe portion 109. This firm surface preferably provides an effective contact point to generate power and agility during striking or passing soccer ball 701.

In some cases, a wearer of article of footwear 100 may catch a pass in order to trap a soccer ball. FIGS. 8-11 illustrate an exemplary embodiment of a wearer of article of footwear 100 trapping soccer ball 801. The scenario illustrated in this embodiment is intended to be exemplary. In other embodiments, a wearer of article of footwear 100 may trap soccer ball 801 in another manner.

Figure 8:
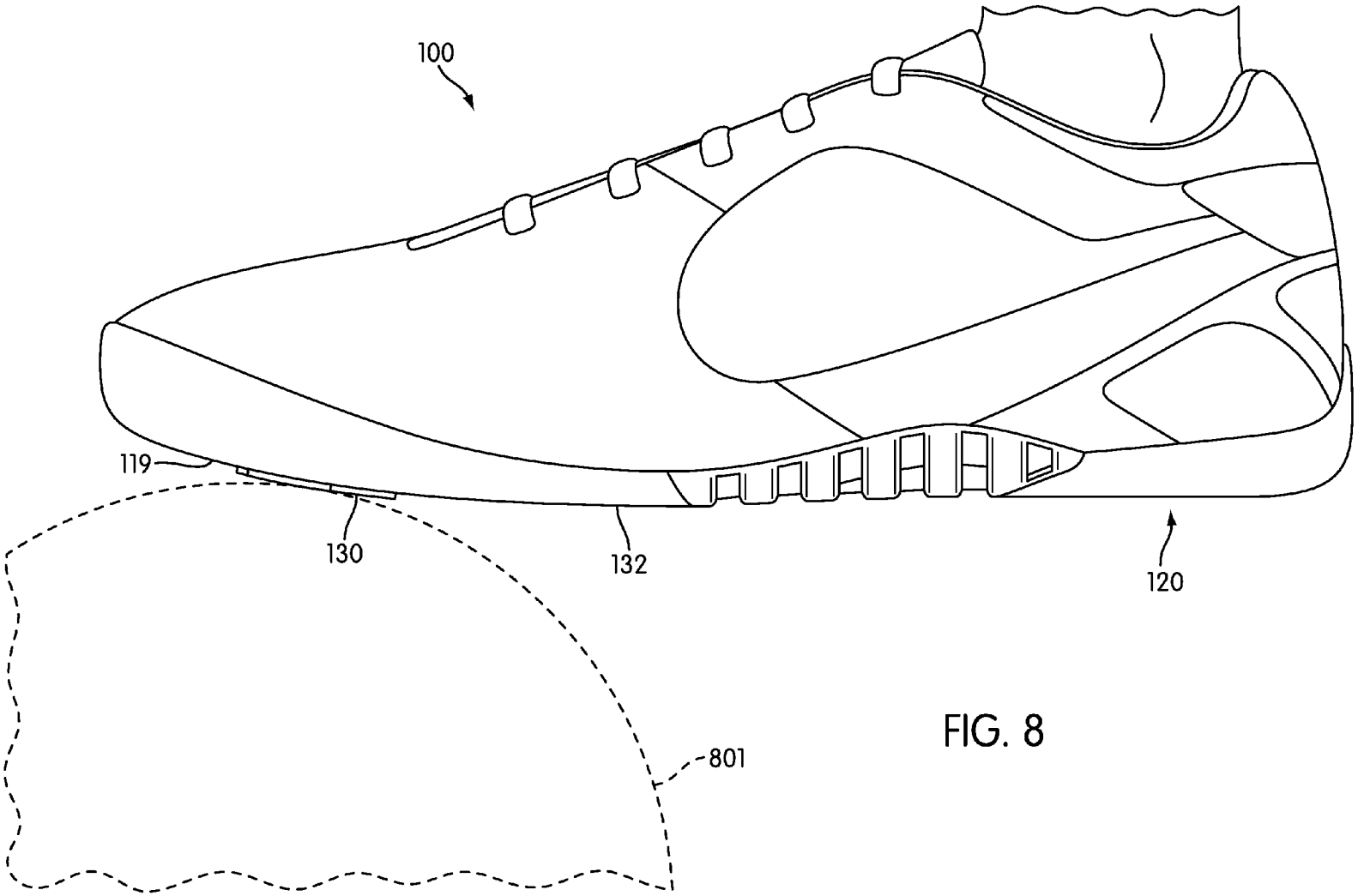
FIG. 8 is a side view of an exemplary embodiment of a wearer of an article of footwear trapping a soccer ball.
Figure 9:
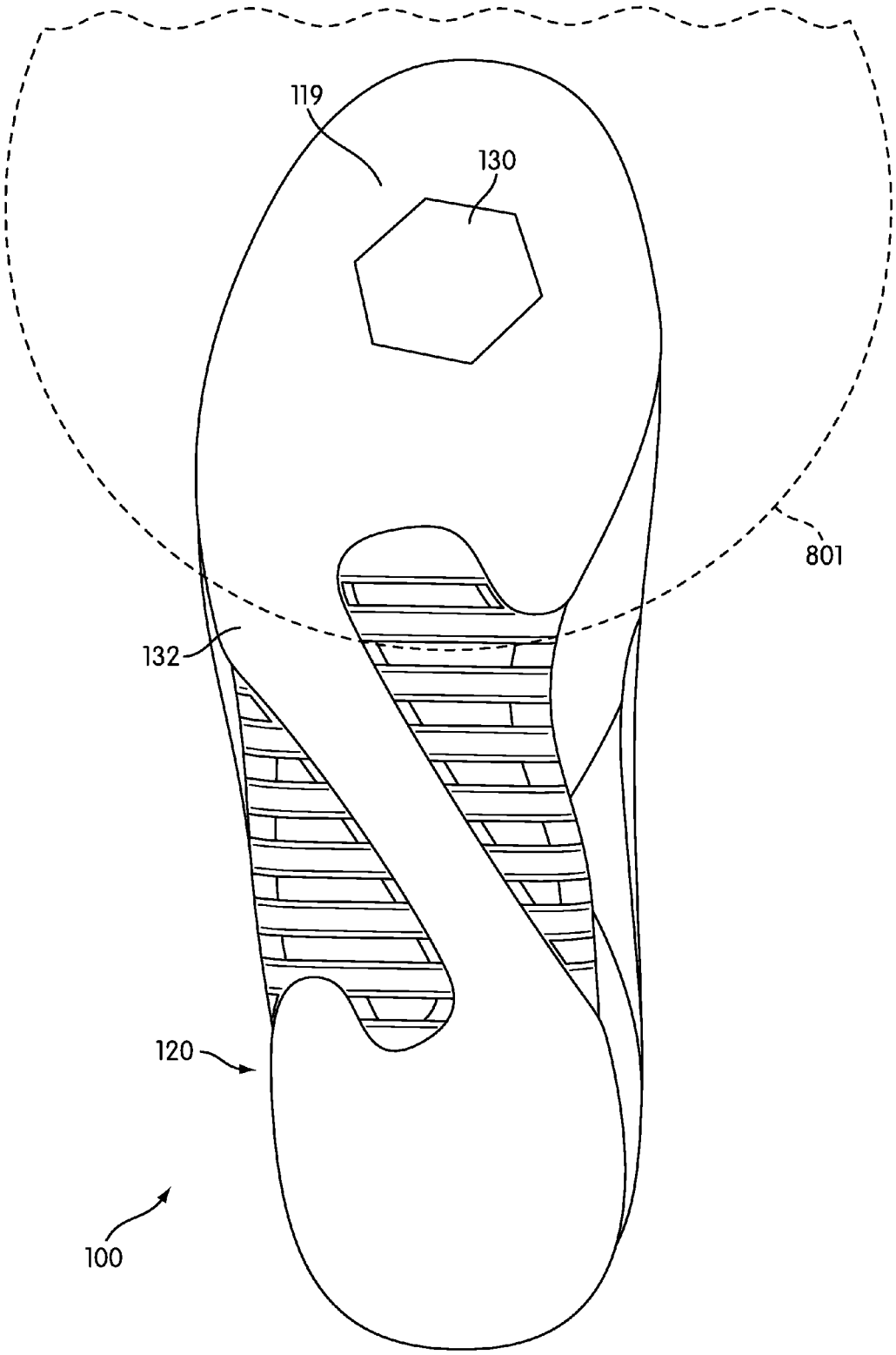
FIG. 9 is an isometric view from underneath an exemplary embodiment of an article of footwear trapping a soccer ball.

Referring to FIGS. 8-9, soccer ball 801 is preferably stopped by toe portion 119 of sole system 120. In particular, central trapping portion 130 contacts soccer ball 801 in order to stop soccer ball 801. In other embodiments, however, soccer ball 801 may be trapped by other portions of article of footwear 100.

Referring to FIG. 9, central trapping portion 130 may be clearly seen contacting soccer ball 801. For purposes of clarity, soccer ball 801 is shown in phantom. Preferably, the relatively high coefficient of friction of central trapping portion 130 facilitates a wearer of article 100 in trapping soccer ball 801. In particular, central trapping portion 130 may be configured to stick to a portion of soccer ball 801 and prevent any further rolling of soccer ball 801 beneath article 100.

Figure 10:
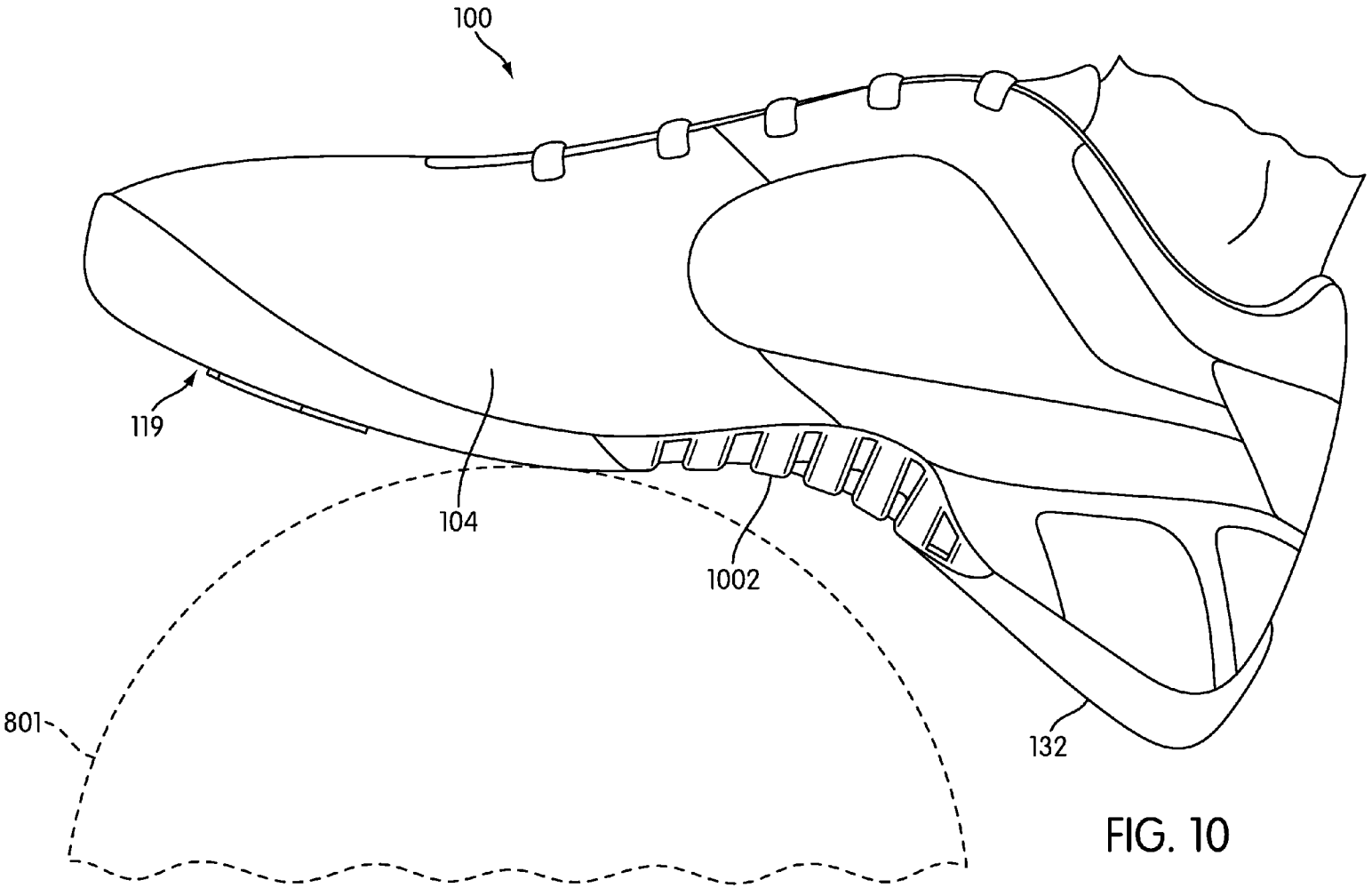
FIG. 10 is a side view of an exemplary embodiment of a wearer of an article of footwear trapping a soccer ball.
Figure 11:
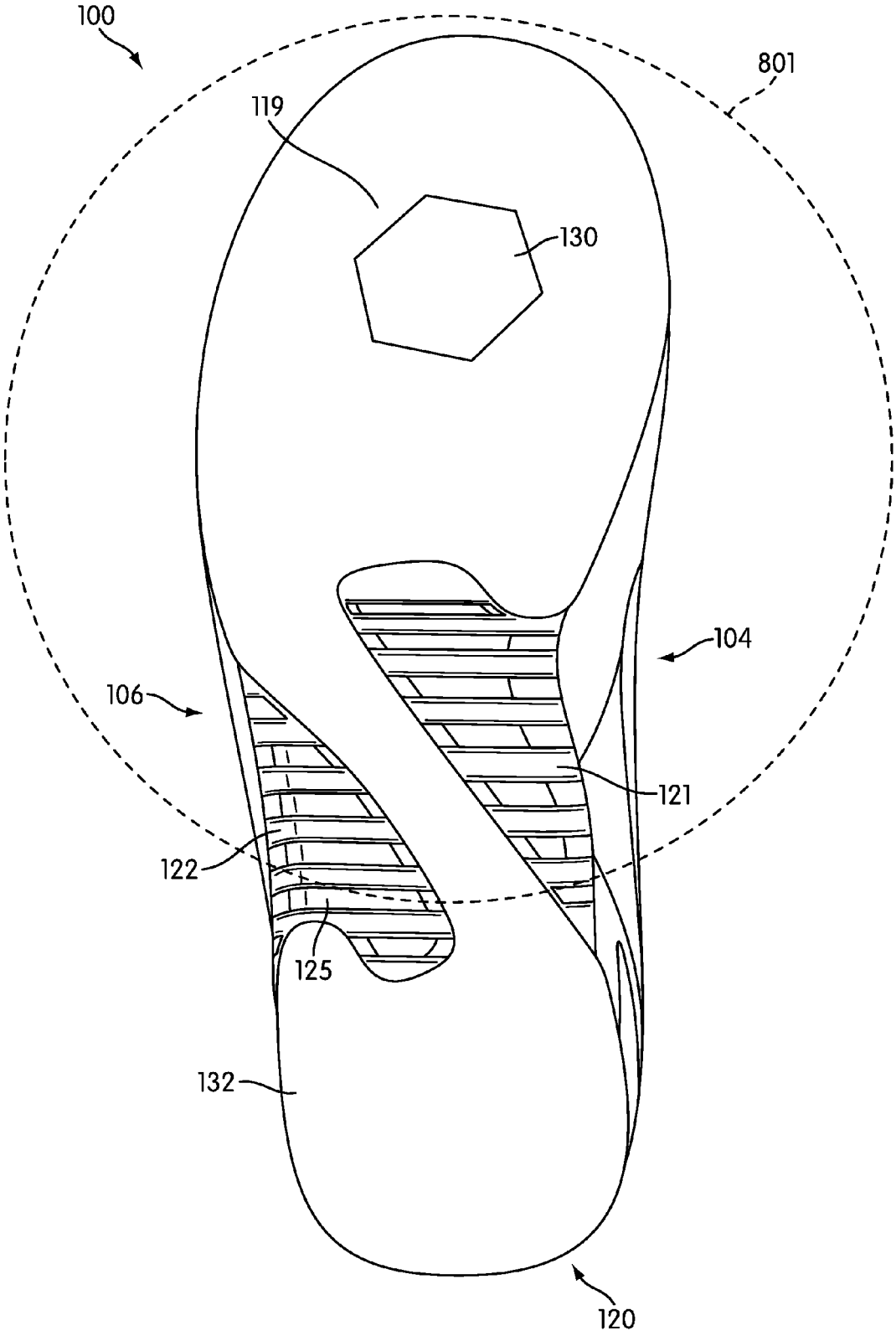
FIG. 11 is an isometric view from underneath an exemplary embodiment of an article of footwear trapping and compressing a soccer ball.

As previously discussed, in order to firmly trap a soccer ball, a wearer may curl a toe portion of an article of footwear toward the soccer ball. This allows the soccer ball to be compressed between a ground surface and the article. Referring to FIGS. 10-11, a wearer arches article of footwear 100 to firmly trap soccer ball 801. In particular, as a wearer traps soccer ball 801, first flexing portion 121 is disposed adjacent to top portion 1002 of soccer ball 801. With this arrangement, toe portion 119 curls toward soccer ball 801 to push soccer ball 801 toward a ground surface. In some cases, a heel portion of article 100 may also bend toward soccer ball 801.

Referring to FIG. 11, soccer ball 801 is illustrated in phantom so that bottom surface 132 of sole system 120 is visible. In this embodiment, as toe portion 119 curls around soccer ball 801, first flexing portion 121 and second flexing portion 122 arches upward. Preferably, slots 125 contract to allow first flexing portion 121 and second flexing portion 122 to bend.

In this example, first flexing portion 121 and second flexing portion 122 may experience different degrees of bending. Specifically, first flexing portion 121 may bend more than second flexing portion 122. In this case, since first flexing portion 121 is disposed adjacent to top portion 1002 of soccer ball 801 as seen in FIG. 10, first flexing portion 121 may undergo bending to conform to the curvature of top portion 1002 of soccer ball 801. Likewise, since second flexing portion 122 is disposed further from top portion 1002 of soccer ball 801, second flexing portion 122 may undergo less bending than first flexing portion 121. Preferably, this configuration allows a wearer of article of footwear 100 to exert greater control to compress soccer ball 801 toward a ground surface and effectively trap soccer ball 801.

In embodiments where a toe portion of an article is used for striking a ball, the article can include provisions for increasing accuracy and power to facilitate striking the ball. In some embodiments, an article of footwear can include a toe bumper that increases the surface area of a toe portion to assist with passing and striking a ball. In some cases, a toe bumper may be configured as part of an upper of an article of footwear. In a preferred embodiment, a toe bumper may be configured as part of a sole system of an article of footwear.

Figure 12:
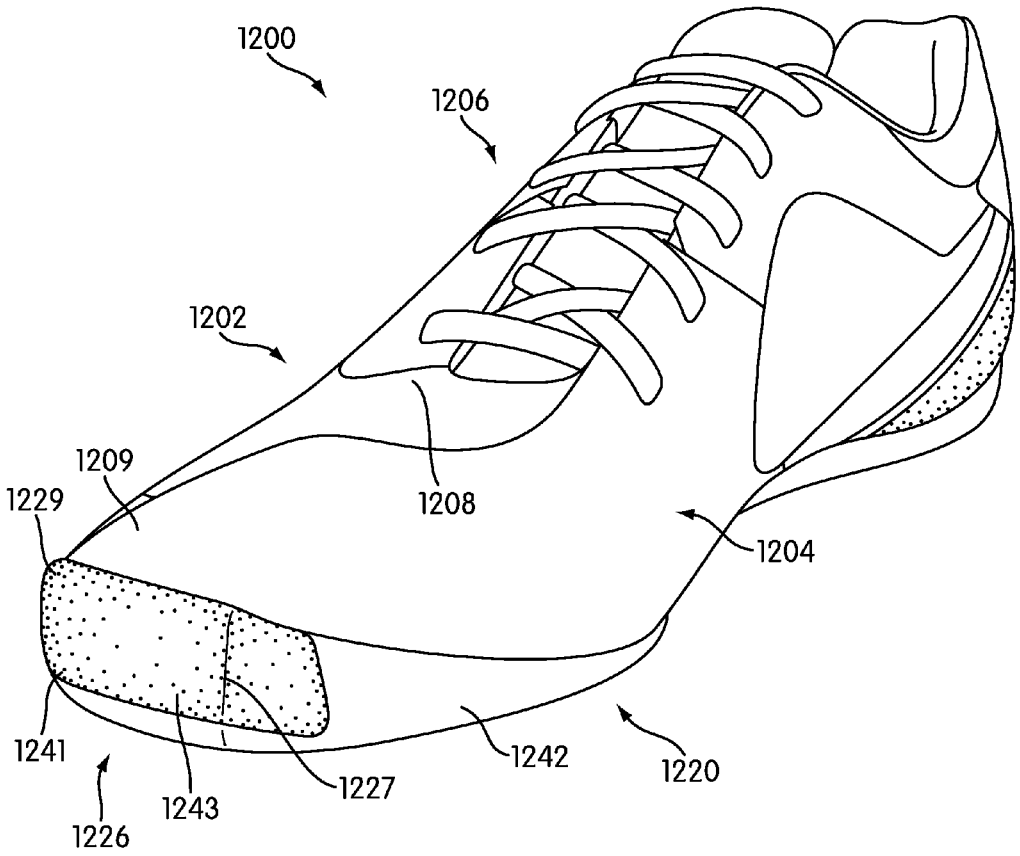
FIG. 12 is an isometric view of a preferred embodiment of an article of footwear.
Figure 13:
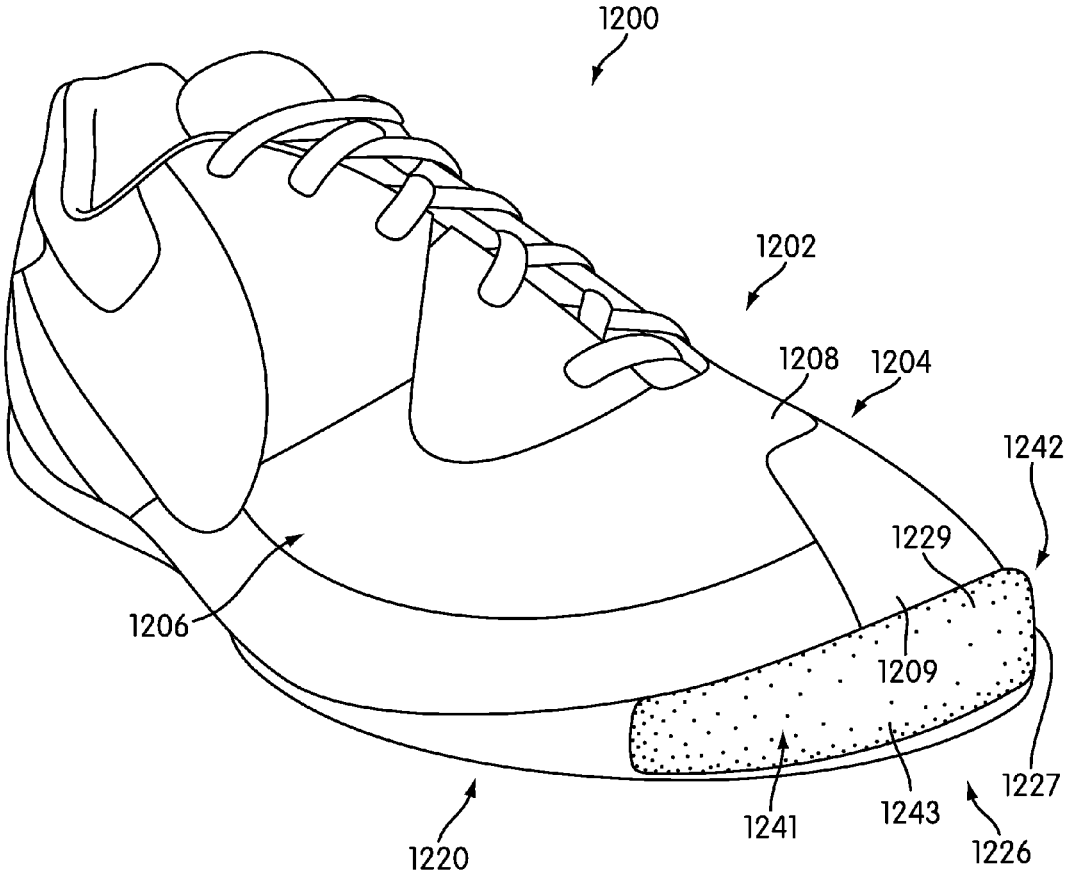
FIG. 13 is an isometric view of a preferred embodiment of an article of footwear.
Figure 14:
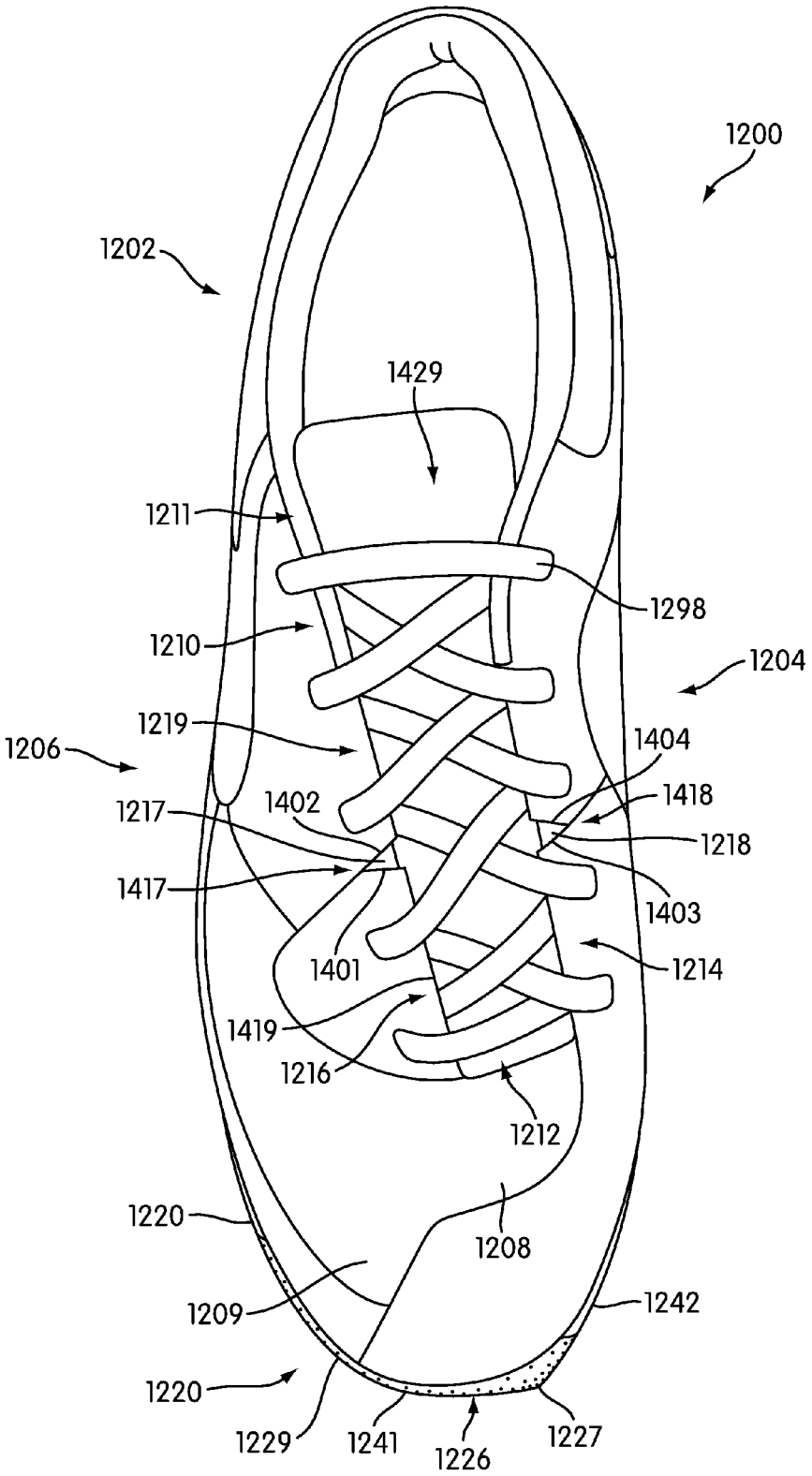
FIG. 14 is a top view of a preferred embodiment of an article of footwear.

FIGS. 12-14 illustrate a preferred embodiment of article of footwear 1200 including provisions for contacting a ball at a toe portion of article 1200. In this embodiment, article of footwear 1200 includes upper 1202 and sole system 1220. Generally, upper 1202 can be any type of upper with any design, shape, size and/or color. In this case, upper 1202 includes medial portion 1204 and lateral portion 1206. In addition, upper 1202 includes intermediate portion 1208 disposed between medial portion 1204 and lateral portion 1206. Also, upper 1202 includes toe portion 1209. For purposes of clarity, only some portions of upper 1202 are discussed in this embodiment.

Sole system 1220 includes front portion 1226. In particular, front portion 1226 may extend upward from a bottom surface of sole system 1220. This configuration may dispose front portion 1226 adjacent to toe portion 1209 of upper 1202. With this configuration, front portion 1226 can contact a ball during striking or passing.

In some embodiments, front portion 1226 of sole system 1220 may include toe bumper 1229. Generally, toe bumper 1229 may be disposed adjacent to toe portion 1209 of upper 1202. Furthermore, toe bumper 1229 may extend from lateral portion 1206 to medial portion 1204 of toe portion 1209. In a preferred embodiment, toe bumper 1229 may be configured with a shape that increases the surface area of front portion 1226 to assist in contacting a ball during passing or striking.

Generally, a toe bumper can be configured with any shape to increase the surface area of a front portion and/or toe portion of an article. In some embodiments, a toe bumper may be configured with a generally symmetric shape. In other words, a toe bumper may cover a medial portion and a lateral portion of an article in a substantially similar manner. For example, a toe bumper may be configured with a curved shape that generally follows the contours of a toe portion of an article. In other embodiments, a toe bumper can be configured with an asymmetrical shape. In some cases, a toe bumper may be configured with an asymmetrical shape that provides more surface area on a medial portion than a lateral portion of an article. In other cases, a toe bumper can include an asymmetrical shape with more surface area on a lateral portion than a medial portion of an article. In a preferred embodiment, a toe bumper is configured with an asymmetrical shape that includes a protrusion.

In this preferred embodiment, toe bumper 1229 includes protrusion 1227 that extends outward slightly from toe portion 1209 with a generally convex shape, as illustrated in FIG. 14. Generally, protrusion 1227 may be disposed on any portion of toe bumper 1229. In some cases, protrusion 1227 may be disposed on medial portion 1204 of toe portion 1209. In other cases, protrusion 1227 may be disposed on lateral portion 1206 of toe portion 1209. In still other cases, protrusion 1227 may be disposed in the middle of toe portion 1209. In a preferred embodiment, protrusion 1227 may be disposed adjacent to toe portion 1209 in approximately the location of a big toe of a foot inserted in article 1200. As seen in FIG. 14, the location of protrusion 1227 provides toe bumper 1229 with an asymmetrical shape.

In this embodiment, toe bumper 1229 includes standard curved portion 1241 and flattened curved portion 1242 that are separated by protrusion 1227. Standard curved portion 1241 may be associated with lateral portion 1206 and intermediate portion 1208 of upper 1202. Similarly, flattened curved portion 1242 can be associated with medial portion 1204.

Preferably, standard curved portion 1241 and flattened curved portion 1242 may be associated with different types of curvature. In particular, flattened curved portion 1242 includes a generally flat shape that may be associated with less surface area than a curved shape. Furthermore, standard curved portion 1241 is configured with a curved shape that is configured to follow the contour of toe portion 1209. This asymmetrical arrangement of toe bumper 1229 can provide a greater surface area for standard curved portion 1241 associated with lateral portion 1206. This arrangement can be particularly helpful for indoor soccer players using lateral portion 1206 of toe portion 1209 to make short and medium distance passes in a "give and go" passing situation. By creating more surface area, standard curved portion 1241 can provide better accuracy for a player passing a ball with lateral portion 1206 of toe portion 1209.

In different embodiments, toe bumper 1229 can be made of different materials. In some cases, toe bumper 1229 can be made of a material that is generally stiffer than the material used for sole system 1220. In other cases, toe bumper 1229 can be made of a softer material than the material used for sole system 1220. In a preferred embodiment, toe bumper 1229 can be made of a stiffer material than sole system 1220 in order to increase support for toe portion 1209 during contact with a ball. In particular, in a preferred embodiment, toe bumper 1229 may be made of rubber.

In different embodiments, toe bumper 1229 can be associated with different coefficients of friction. In some cases, toe bumper 1229 can have a greater coefficient of friction than sole system 1220. In other words, toe bumper 1229 can be stickier than sole system 1220. In other cases, toe bumper 1229 can have a lower coefficient of friction than sole system 1220. In other words, toe bumper 1229 can be slicker than sole system 1220. In a preferred embodiment, toe bumper 1229 has a greater coefficient of friction than sole system 1220 in order to facilitate contact with a ball.

In some embodiments, toe bumper 1229 may include additional provisions to increase traction between article 1200 and a ball in order to increase the accuracy of kicks and passes. Referring to FIGS. 12-13, toe bumper 1229 includes textured surface 1243. Textured surface 1243 can be configured in any manner. In some cases, textured surface 1243 may include one or more divots. In other cases, textured surface 1243 can include one or more bumps. In this preferred embodiment, textured surface 1243 comprises small bumps that bulge outward from toe bumper 1229. In particular, these small bumps may be substantially evenly spaced over the entirety of toe bumper 1229. Preferably, textured surface 1243 assists a player in contacting a ball by providing a high coefficient of friction with the ball.

Generally, toe bumper 1229 may be associated with sole system 1220 in any manner. In some embodiments, toe bumper 1229 may be integrally formed with sole system 1220. In other embodiments, toe bumper 1229 may be attached to sole system 1220 through any manner known in the art including, but not limited to adhesives and stitching. In this embodiment, toe bumper 1229 is attached to front portion 1226 through stitching.

In embodiments including a sole system that is configured to flex, an article may include provisions to facilitate flexing of the upper in order to accommodate flexing of the entire article. Generally, provisions for facilitating flexing of an upper can be provided on any portion of an upper. In a preferred embodiment, a fastening system may include stretching portions to accommodate flexing and bending of an article of footwear. The term "stretching portion" as used throughout this detailed description and in the claims refers to any portion configured to undergo elastic deformation.

Referring to FIG. 14, upper 1202 includes lacing portion 1210 configured to receive lace 1298. In particular, lace 1298 may span lacing gap 1429 of upper 1202 in order to fasten upper 1202. In other embodiments, article of footwear 1200 can include another type of fastening system. In this embodiment, lacing portion 1210 is configured with an asymmetrical bias in manner substantially similar to lacing portion 110 of article 100 illustrated in FIGS. 1-3. With this asymmetrical bias, first end portion 1211 of lacing portion 1210 is disposed on intermediate portion 1208 of upper 1202 while second end portion 1212 of lacing portion 1210 is disposed on medial portion 1204.

In this preferred embodiment, lacing portion 1210 includes first stretching portion 1217 and second stretching portion 1218. Generally, first stretching portion 1217 and second stretching portion 1218 may be made of any material configured to flex. Examples of different flexible materials include, but are not limited to elastic, nylon, rubber, as well as other materials that are configured to stretch. In a preferred embodiment, first stretching portion 1217 and second stretching portion 1218 may be made of elastic. With this arrangement, lacing portion 1210 may stretch at first stretching portion 1217 and second stretching portion 1218 to accommodate the bending of sole system 1220.

Generally, stretching portions may be disposed on any portion of a fastening system to increase the flexibility of an upper. In some embodiments, stretching portions may be disposed on both a medial portion and a lateral portion of a fastening system. In other embodiments, stretching portions may be disposed only on a medial portion. In still other embodiments, stretching portions may be disposed only on a lateral portion. In a preferred embodiment, stretching portions may be disposed on both a medial portion and a lateral portion of a fastening system.

In this embodiment, first stretching portion 1217 is disposed on lateral lacing portion 1216 of lacing portion 1210. Similarly, second stretching portion 1218 is disposed on medial lacing portion 1214 of lacing portion 1210. Furthermore, first stretching portion 1217 and second stretching portion 1218 are disposed on middle portion 1219 of lacing portion 1210 between first end portion 1211 and second end portion 1212. With this configuration, first stretching portion 1217 and second stretching portion 1218 can provide flexibility to both lateral portion 1206 and medial portion 1204 to provide flexibility for upper 1202. Furthermore, with this arrangement, upper 1202 may be configured to bend in a manner that cooperates with the bending of sole system 1220.

Generally, first stretching portion 1217 and second stretching portion 1218 can be configured with lacing portion 1210 in any manner known in the art. In some embodiments, first stretching portion 1217 and second stretching portion 1218 may be integrally formed with lateral lacing portion 1216 and medial lacing portion 1214, respectively. In other embodiments, first stretching portion 1217 and second stretching portion 1218 can be attached to lateral lacing portion 1216 and medial lacing portion 1214, respectively. This may be accomplished by any manner known in the art including, but not limited to stitching and adhesives. In a preferred embodiment, first stretching portion 1217 and second stretching portion 1218 may be attached to cut out portions in lateral lacing portion 1216 and medial lacing portion 1214, respectively.

In this embodiment, lateral lacing portion 1216 includes first cut out portion 1417 adjacent to periphery portion 1419 of lacing portion 1210. Similarly, medial lacing portion 1214 includes second cut out portion 1418 adjacent to periphery portion 1419. Generally, first cut out portion 1417 and second cut out portion 1418 may be configured with any size and shape. In this arrangement, first cut out portion 1417 and second cut out portion 1418 are configured with generally triangular shapes. In particular, first cut out portion 1417 comprises first side 1401 and second side 1402 adjacent to periphery portion 1419. Likewise, second cut out portion 1418 includes third side 1403 and fourth side 1404 adjacent to periphery portion 1419.

Preferably, first stretching portion 1217 spans first cut out portion 1417. In a similar manner, second stretching portion 1218 extends across second cut out portion 1418. This arrangement disposes first stretching portion 1217 and second stretching portion 1218 on periphery portion 1419 of lacing portion 1210 adjacent to lacing gap 1429.

In this embodiment, first stretching portion 1217 is attached to lateral lacing portion 1216 at first side 1401 and second side 1402 of first cut out portion 1417. Likewise, second stretching portion 1218 is attached to medial lacing portion 1214 at third side 1403 and fourth side 1404 of second cut out portion 1418. In other embodiments, first stretching portion 1217 and second stretching portion 1218 can be attached to different portions of first cut out portion 1417 and second cut out portion 1418, respectively. Using this arrangement, first stretching portion 1217 and second stretching portion 1218 can be fastened to lateral lacing portion 1216 and medial lacing portion 1214, respectively. This allows first stretching portion 1217 and second stretching portion 1218 to flex to accommodate curling of toe portion 1209 when a wearer traps a ball.

Although two stretching portions are used in the current embodiment, in different embodiments, the number of stretching portions can vary. In some embodiments, more than two stretching portions can be used. For example, in an alternative embodiment, additional pairs of stretching portions can be disposed on adjacent edges of a lacing portion of an upper. By using additional stretching portions, an upper can be configured to accommodate bending in different locations of the upper.

In activities where heel passes may be used, an article of footwear can include provisions that facilitate kicking a ball with a heel portion of the article. In particular, since heel passes are usually made using a medial portion of the heel portion, an article may include provisions for kicking the ball with a medial portion of the heel portion of the article.

Figure 15:
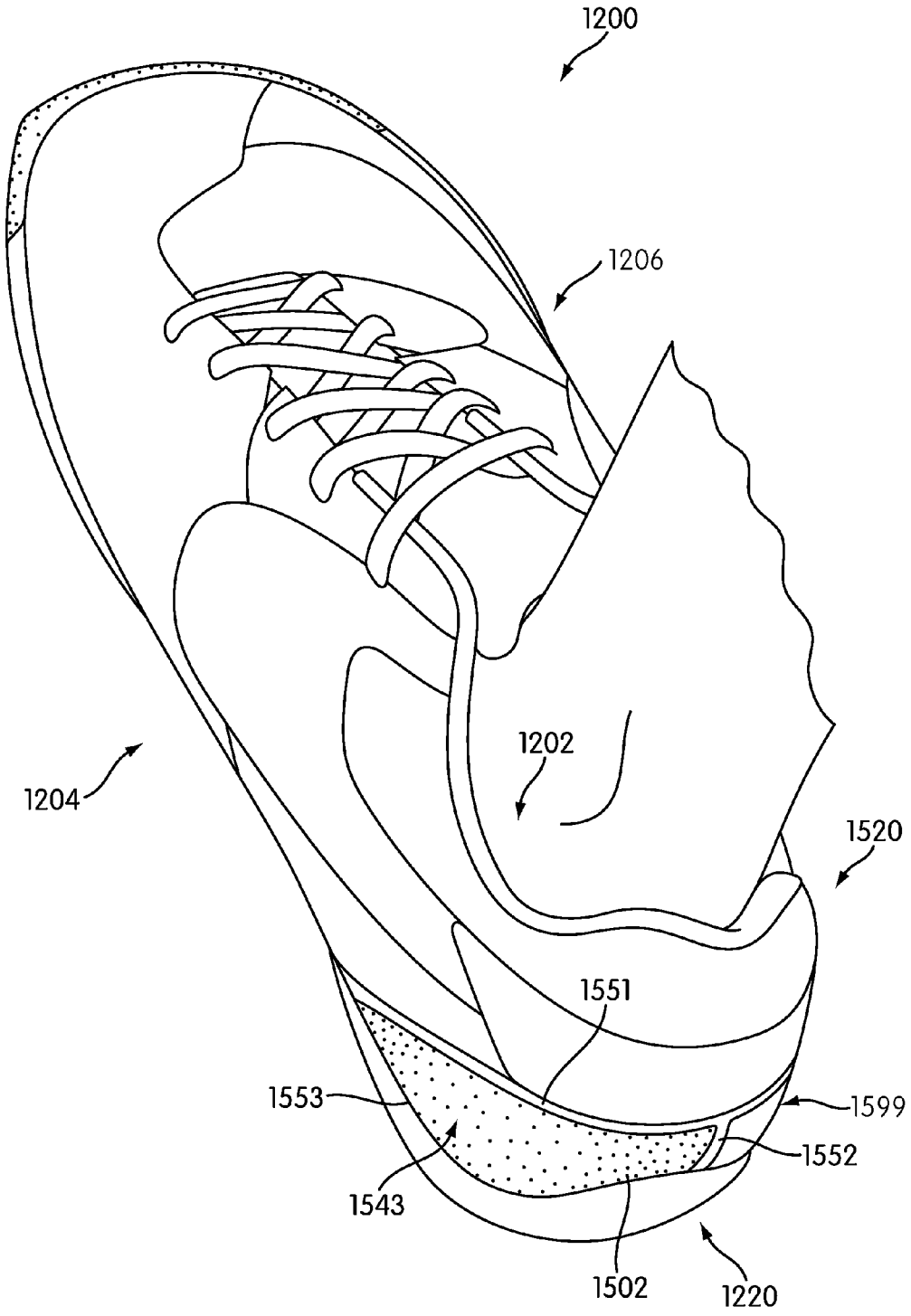
FIG. 15 is an isometric view of a preferred embodiment of an article of footwear.
Figure 16:
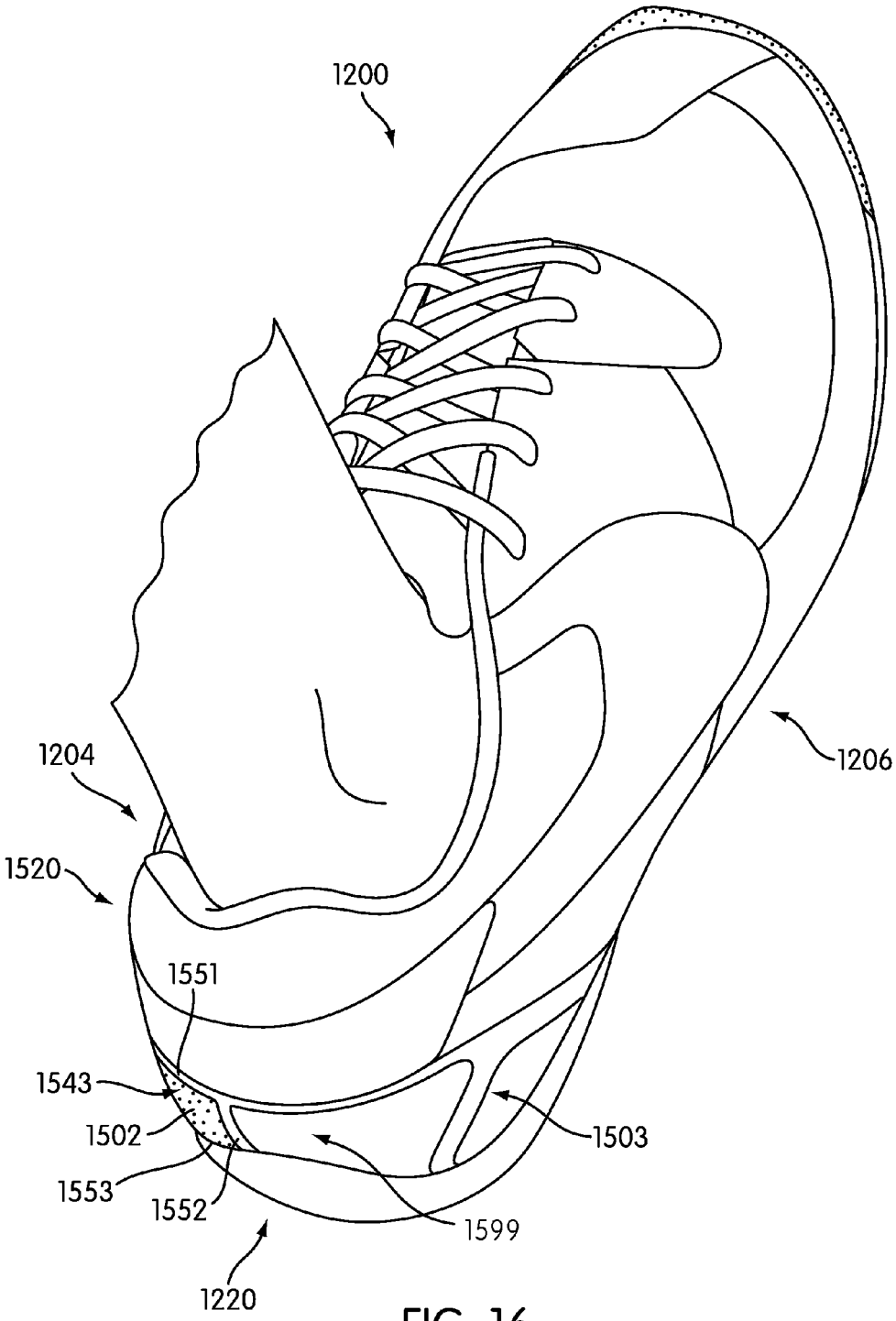
FIG. 16 is an isometric view of a preferred embodiment of an article of footwear.

Referring to FIGS. 15 and 16, article of footwear 1200 includes heel portion 1520. Preferably, heel portion 1520 is configured to cradle a heel of a wearer. In some cases, heel portion 1520 may include provisions to increase support for a heel of a wearer. In the current embodiment, heel portion 1520 includes heel counter 1503, as illustrated in FIG. 16. Although only a portion of heel counter 1503 is visible in FIG. 16, it should be understood that heel counter 1503 may cover a majority of heel portion 1520. With this arrangement, heel counter 1503 can provide support for a heel of a foot inserted within article 1200.

In this preferred embodiment, heel portion 1520 includes heel bumper 1502. Heel bumper 1502 is disposed on medial portion 1204 of heel portion 1520, as illustrated in FIG. 15. Specifically, heel bumper 1502 is disposed on medial portion 1204 adjacent to sole system 1220. In some cases, heel bumper 1502 may cover a portion of heel counter 1503. Using this preferred arrangement, heel bumper 1502 can facilitate contact between a ball and medial portion 1204 of heel portion 1520 during a heel pass.

Preferably, heel bumper 1502 is configured with a shape that enables a wearer to contact a ball with heel bumper 1502. In this embodiment, heel bumper 1502 is configured with an asymmetrical shape. In particular, heel bumper 1502 comprises a generally rounded triangular shape. In other embodiments, heel bumper 1502 may be configured with another shape. Examples of other shapes include, but are not limited to, rectangular shapes, circular shapes, elliptical shapes, regular shapes and irregular shapes as well as other types of shapes. During a heel pass, only a portion of a ball may contact medial portion 1204 of heel portion 1520. In some cases, heel bumper 1502 may be configured with a shape that agrees with the shape of a portion of a ball that may contact medial portion 1204 of heel portion 1520 during a heel pass.

In some embodiments, heel bumper 1502 includes curved edge 1551 disposed adjacent to upper 1202. Curved edge 1551 connects to bottom edge 1553 disposed adjacent to sole system 1220. Furthermore, curved edge 1551 also joins rearward edge 1552, which is disposed proximate to lateral portion 1206. In particular, rearward edge 1552 is disposed in rearward portion 1599 of heel portion 1520, which is disposed between medial portion 1204 and lateral portion 1206. With this configuration, heel bumper 1502 is configured to contact a ball at medial portion 1204 of heel portion 1520.

Generally, a heel bumper can be made any material including, but not limited to elastomers, siloxanes, natural rubber, synthetic rubbers, natural leather, synthetic leather, or plastics. In some embodiments, a heel bumper may be configured with a rubber-like material that can absorb some of the force of a pass or strike. In other embodiments, a heel bumper can comprise a material with a high coefficient of friction in order to grip a ball during passing. In a preferred embodiment, a heel bumper can comprise a rubber-like material that absorbs some of the force of a pass or a strike and include a textured surface with a high coefficient of friction.

In some embodiments, a heel bumper may include provisions to help increase traction with a ball in order to improve the accuracy of a heel pass. In some cases, the heel bumper may be made of a material with an increased coefficient of friction in order to increase traction between the heel bumper and a contacting ball. In other cases, the heel bumper could include a textured surface that is configured to increase traction between the toe bumper and a contacting ball. In a preferred embodiment, the heel bumper includes a textured surface with small protrusions.

In this embodiment, heel bumper 1502 includes textured surface 1543. Preferably, textured surface 1543 comprises a surface with a high coefficient of friction to engage a ball following contact with the ball. In this embodiment, textured surface 1543 comprises small densely packed bumps. However, in other embodiments, textured surface 1543 may be configured in another manner. For example, in other embodiments, textured surface 1543 could comprise divots, large bumps, as well as other arrangements. With this configuration, heel bumper 1502 may help increase traction with a ball to increase the accuracy of a heel pass.

Figure 17:
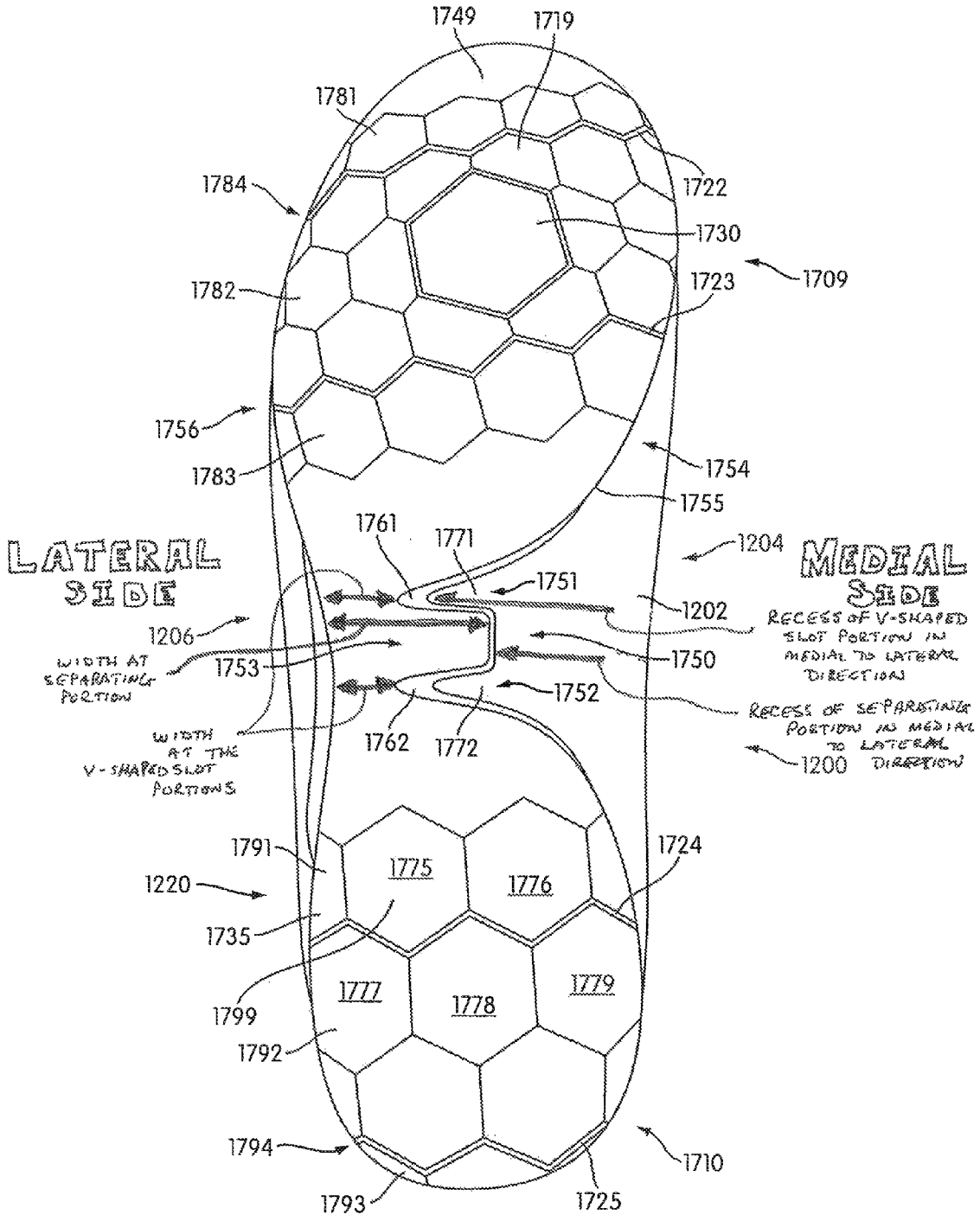
FIG. 17 is a plan view of a preferred embodiment of a bottom surface of a sole system of an article of footwear.

FIG. 17 illustrates a plan view of a preferred embodiment of bottom surface 1735 of sole system 1220 of article 1200. Bottom surface 1735 is configured to contact a ground surface, including, but not limited to natural grass, synthetic grass, tile, concrete, as well as any other types of surfaces. For the purposes of illustration, the top surface of sole system 1220 is not shown in these Figures.

In this embodiment, an outsole of sole system 1220 may be visible. However, it should be understood that sole system 1220 can also include a midsole and/or an insole. Additionally, in some cases, sole system 1220 may include additional provisions for traction including, but not limited to cleats and traction elements.

In embodiments where an article is used for trapping a ball, a sole system may include provisions for flexing. In some embodiments, a sole system can also be configured with a particular shape to facilitate curling of a toe portion. In some cases, an arch portion of a sole system can comprise a shape that facilitates the curling of a toe portion. In a preferred embodiment, an arch portion of a sole system includes slot portions that compress inward when an arch portion bends to facilitate the curling of a toe portion of the sole system.

In different embodiments, the number of slot portions can vary. In some cases, a sole system may include a single slot portion. In other cases, a sole system may include two or more slot portions. In this embodiment, arch portion 1750 of sole system 1220 includes first slot portion 1751 and second slot portion 1752.

Generally, the location of first slot portion 1751 and second slot portion 1752 may vary. In some embodiments, first slot portion 1751 and second slot portion 1752 may be associated with medial portion 1754 of sole system 1220. In other embodiments, first slot portion 1751 and second slot portion 1752 may be associated with lateral portion 1756 of sole system 1220. In a preferred embodiment, first slot portion 1751 and second slot portion 1752 may be associated with medial portion 1754 of sole system 1220. In particular, first slot portion 1751 is disposed adjacent to forefoot portion 1709 of sole system 1220. Likewise, second slot portion 1752 is disposed adjacent to heel portion 1710 of sole system 1220. Furthermore, first slot portion 1751 and second slot portion 1752 may be coextensive with periphery portion 1755 of bottom surface 1735. As a result, first slot portion 1751, second slot portion 1752 may provide a recessed periphery portion 1755 of bottom surface 1735, as shown in FIG. 17. Periphery portion 1755 may be recessed in a direction extending between medial portion 1754 and lateral portion 1756. Using this configuration, arch portion 1750 can compress inward at first slot portion 1751 and second slot portion 1752 to enable bending of arch portion 1750.

In this embodiment, first slot portion 1751 is separated from second slot portion 1752 by separating portion 1753. As shown in FIG. 17, first slot portion 1751, second slot portion 1752, and separating portion 1753 may form a continuous recessed periphery portion 1755 of bottom surface 1735. The recessed periphery portion 1755 may be located in arch portion 1750. Generally, separating portion 1753 may be configured with any shape. Examples of different shapes for a separating portion include, but are not limited to, triangular shapes, rectangular shapes, trapezoidal shapes, elliptical shapes, regular shapes, irregular shapes, as well as other types of shapes. In a preferred embodiment, separating portion 1753 is configured with a generally rectangular shape.

Generally, slot portions can be configured with any shape to facilitate the curling of a toe portion of a sole system. In some embodiments, slot portions can be configured with shapes that allow a medial portion and a lateral portion of a sole system to bend in a substantially similar manner. In a preferred embodiment, slot portions can be configured with shapes that allow a medial portion and a lateral portion to bend in different manners.

In some embodiments, first slot portion 1751 and second slot portion 1752 can have substantially similar shapes. In other embodiments, first slot portion 1751 and second slot portion 1752 can have different shapes. In a preferred embodiment, first slot portion 1751 and second slot portion 1752 can have substantially similar shapes.

In this preferred embodiment, first slot portion 1751 and second slot portion 1752 may be approximately V-shaped. In particular, first slot portion 1751 includes first narrow portion 1761 and first wide portion 1771. In a similar manner, second slot portion 1752 includes second narrow portion 1762 and second wide portion 1772. In this embodiment, first wide portion 1771 and second wide portion 1772 are disposed adjacent to medial portion 1754. Similarly, first narrow portion 1761 and second narrow portion 1762 are disposed proximate to lateral portion 1756 of sole system 1220.

Preferably, first wide portion 1771 and second wide portion 1772 cover a greater area than first narrow portion 1761 and second narrow portion 1762. Since first wide portion 1771 and second wide portion 1772 cover a greater area than first narrow portion 1761 and second narrow portion 1762, first wide portion 1771 and second wide portion 1772 may be configured to compress inward to a greater degree than first narrow portion 1761 and second narrow portion 1762. This can allow medial portion 1754 to bend more than lateral portion 1756. With this preferred configuration, first slot portion 1751 and second slot portion 1752 may also facilitate twisting of forefoot portion 1709 with respect to heel portion 1710, which can result in a more effective trapping of a ball.

Generally, the orientation of one or more slot portions can vary. In this embodiment, first slot portion 1751 and second slot portion 1752 extend in a generally lateral direction. In other embodiments, first slot portion 1751 and second slot portion 1752 may extend in other directions. In some cases, the orientation of first slot portion 1751 and second slot portion 1752 can be changed in order to fine tune the flexing properties of arch portion 1750.

First slot portion 1751 and second slot portion 1752 may be formed in any manner known in the art. In some embodiments, material from sole system 1220 may be removed to form first slot portion 1751 and second slot portion 1752. In some cases, only a portion of a sole system 1220 may be removed to form first slot portion 1751 and second slot portion 1752. For example, an outsole of sole system 1220 can be removed to form first slot portion 1751 and second slot portion 1752. As a result, at least a portion of upper 1202 may be exposed through the first slot portion 1751 and the second slot portion 1752, as shown in FIG. 17. In other words, at least the first slot portion 1751 and the second slot portion 1752 may form an opening through the bottom surface of the sole system so that a portion of upper 1202 may be exposed through the opening. In this preferred embodiment, first slot portion 1751 and second slot portion 1752 are integrally formed with sole system 1220. With this arrangement, arch portion 1750 is configured with a shape that can compress inward to enable bending of arch portion 1750. This bending can facilitate the curling of toe portion 1719 of sole system 1220.

In some embodiments, a sole system may also include provisions for increasing the flexibility of the forefoot and heel portions of an article. Referring to FIG. 17, sole system 1220 may include one or more flexing grooves to increase the flexibility of sole system 1220. In some cases, flexing grooves can be disposed on forefoot portion 1709 of sole system 1220. In other cases, flexing grooves can be disposed on heel portion 1710 of sole system 1220. In still other cases, flexing grooves can be disposed on arch portion 1750 of sole system 1220. In a preferred embodiment, both forefoot portion 1709 and heel portion 1710 can include flexing grooves.

In order to increase the flexibility of forefoot portion 1709, sole system 1220 includes forefoot flexing groove set 1784 disposed on forefoot portion 1709. In addition, sole system 1220 includes heel flexing groove set 1794 disposed on heel portion 1710. Preferably, forefoot flexing groove set 1784 and heel flexing groove set 1794 may allow forefoot portion 1709 and heel portion 1710, respectively, to bend in order to facilitate trapping a ball.

Generally, forefoot flexing groove set 1784 and heel flexing groove set 1794 can include any number of flexing grooves to increase the flexibility of forefoot portion 1709 and heel portion 1710, respectively. In some cases, forefoot flexing groove set 1784 and heel flexing groove set 1794 can include a similar number of flexing grooves. In other cases, forefoot flexing groove set 1784 and heel flexing groove set 1794 can include a different number of flexing grooves. In a preferred embodiment, forefoot flexing groove set 1784 and heel flexing groove set 1794 each include two flexing grooves.

In this embodiment, forefoot flexing groove set 1784 may include first forefoot flexing groove 1722 and second forefoot flexing groove 1723. Preferably, first forefoot flexing groove 1722 is disposed between first portion 1781 and second portion 1782 of forefoot portion 1709. Likewise, second forefoot flexing groove 1723 is disposed between second portion 1782 and third portion 1783 of forefoot portion 1709. With this arrangement, first portion 1781 and second portion 1782 may be configured to flex with respect to one another at first forefoot flexing groove 1722. Likewise, second portion 1782 and third portion 1783 may be configured to flex with respect to one another at second forefoot flexing groove 1723.

In this embodiment, heel flexing groove set 1794 includes first heel flexing groove 1724 and second heel flexing groove 1725. Preferably, first heel flexing groove 1724 is disposed between first portion 1791 and second portion 1792 of heel portion 1710. Likewise, second heel flexing groove 1725 is disposed between second portion 1792 and third portion 1793 of heel portion 1710. With this arrangement, first portion 1791 and second portion 1792 may be configured to flex with respect to one another at first heel flexing groove 1724. Likewise, second portion 1792 and third portion 1793 may be configured to flex with respect to one another at second heel flexing groove 1725.

In some embodiments, sole system 1220 may be provided with a tread pattern. In some cases, the tread pattern can comprise repeating shapes. Generally, the repeating shapes can be any type of shape, including but not limited to regular shapes, such as circles, squares, hexagons, rectangles, as well as irregular shapes. In a preferred embodiment, sole system 1220 includes tread pattern 1799 with repeating hexagon shapes.

In different embodiments, the shape of flexing grooves can vary. In some cases, flexing grooves may have generally straight shapes. In other cases, flexing grooves could have zig-zag shapes. In a preferred embodiment, flexing grooves may have a shape that corresponds to the contours of tread pattern 1799 of sole system 1220.

As seen in FIG. 17, forefoot flexing groove set 1784 and heel flexing groove set 1794 may be associated with shapes that are contoured to the edges of tread pattern 1799. For example, first heel flexing groove 1724 is disposed between the edges of first hexagon 1775, second hexagon 1776, third hexagon 1777, fourth hexagon 1778 and fifth hexagon 1779. Preferably, the remaining flexing grooves are shaped to agree with the contours between the edges of adjacent hexagons in a similar manner.

For aesthetic purposes, some portions of sole system 1220 may be configured with a different appearance. For example, portions of sole system 1220 can comprise different colors. In this preferred embodiment, second portion 1782 of forefoot portion 1709 and second portion 1792 of heel portion 1710 can be relatively transparent. In contrast, first portion 1781 and third portion 1783 of forefoot portion 1709 as well as first portion 1791 and third portion 1793 of heel portion 1710 can have an opaque appearance. Preferably, this configuration provides an aesthetically appealing appearance for bottom surface 1735 of sole system 1220.

Similar to previous embodiments, toe portion 1719 also includes a central trapping portion for gripping a ball during trapping. In this embodiment, toe portion 1719 includes central trapping portion 1730. Central trapping portion 1730 is disposed adjacent to peripheral toe portion 1749 of toe portion 1719. Preferably, peripheral toe portion 1749 bounds central trapping portion 1730 and extends to the edges of toe portion 1719. With this configuration, peripheral toe portion 1749 can be configured to contact a ground surface while central trapping portion 1730 is configured to contact a ball. In addition, central trapping portion 1730 is disposed within second portion 1782 of forefoot portion 1709.

In some embodiments, peripheral toe portion 1749 and central trapping portion 1730 can have different coefficients of friction. For example, in one embodiment, central trapping portion 1730 can have a greater coefficient of friction than peripheral toe portion 1749 to increase traction with a ball at central trapping portion 1730. In a preferred embodiment, however, peripheral toe portion 1749 and central trapping portion 1730 can have substantially similar coefficients of friction.

As previously discussed, central trapping portion 1730 may be configured in any shape and with any size. In this embodiment, central trapping portion 1730 is configured with a hexagonal shape substantially similar, but smaller, than a panel of a soccer ball. Furthermore, central trapping portion 1730 is slightly raised with respect to bottom surface 1735. With this configuration, central trapping portion 1730 preferably facilitates the trapping of a soccer ball.

Figure 18:
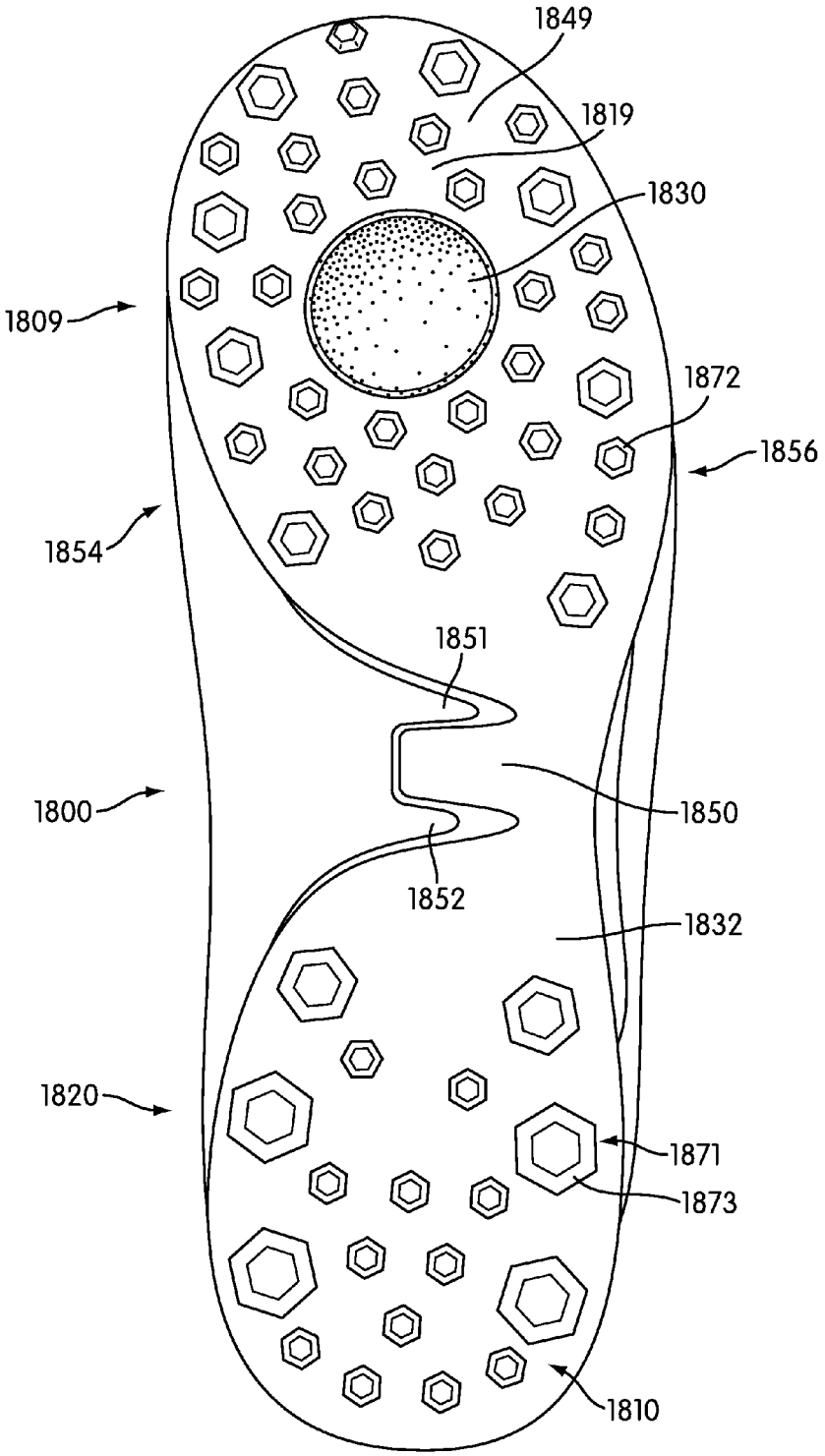
FIG. 18 is a plan view of an alternative embodiment of a bottom surface of a sole system of an article of footwear.

FIG. 18 is an alternative embodiment of sole system 1820 of article of footwear 1800. In this embodiment, sole system 1820 includes bottom surface 1832. Bottom surface 1832 is configured to contact a ground surface, including, but not limited to natural grass, synthetic grass, tile, concrete, as well as any other types of surfaces. For the purposes of illustration, the top surface of sole system 1820 is not shown in these Figures. Furthermore, in some cases, sole system 1820 may include a midsole and/or insole that are not illustrated in these Figures for purposes of clarity.

In order to provide traction with a ground surface, bottom surface 1832 is configured with cleats 1871. In other embodiments, bottom surface 1832 may not include cleats 1871. In some cases, bottom surface 1832 can include additional provisions for increasing traction with a ground surface such as tread elements.

Generally, cleats 1871 can be configured in any manner on bottom surface 1832. In this embodiment, cleats 1871 include small cleats 1872 and large cleats 1873. Preferably, small cleats 1872 and large cleats 1873 are disposed on forefoot portion 1809 and heel portion 1810 of sole system 1820. Furthermore, in this preferred embodiment, large cleats 1873 may be disposed on a periphery of sole system 1820. With this arrangement, cleats 1871 provide traction for article 1800.

In some embodiments, sole system 1820 can also include provisions to help with shock absorption. For example, in some embodiments, sole system 1820 can include a fluid filled bladder. An example of such a bladder is disclosed in U.S. Pat. No. 7,070,845, the entirety of which is hereby incorporated by reference. Generally, a fluid filled bladder may be provided in any portion of sole system 1820, such as a forefoot portion, an arch portion or a heel portion of sole system 1820. Preferably, in embodiments including a fluid filled bladder, the fluid filled bladder is disposed beneath bottom surface 1832 of sole system 1820. For purposes of clarity, no fluid filled bladder is shown in this embodiment.

In embodiments including trapping portions, the trapping portions can be provided with shapes to facilitate contact with a ball. In some embodiments, trapping portions may protrude from a bottom surface of a sole system. In other embodiments, trapping portions may be recessed with respect to a bottom surface of a sole system. This can enhance the ability of a wearer to trap a ball with a trapping portion.

In order to assist a wearer trapping a ball, bottom surface 1832 includes central trapping portion 1830. Central trapping portion 1830 is disposed in a substantially similar manner as the previous embodiment of central trapping portion 1730 illustrated in FIG. 17. Specifically, central trapping portion 1830 is disposed on toe portion 1819. In addition, central trapping portion 1830 is bounded by peripheral toe portion 1849 that extends from central trapping portion 1830 to edges of toe portion 1819. With this arrangement, peripheral toe portion 1849 may be configured to contact a ground surface while central trapping portion 1830 is configured to contact a ball.

Generally, central trapping portion 1830 can be configured with any shape and size to trap a ball. In this embodiment, central trapping portion 1830 comprises a circular shape. However, in other embodiments, central trapping portion 1830 can comprise another shape. Examples of different shapes for a trapping portion include, but are not limited to, triangular shapes, rectangular shapes, trapezoidal shapes, elliptical shapes, regular shapes, irregular shapes, as well as other types of shapes.

In some embodiments, central trapping portion 1830 may be recessed with respect to bottom surface 1832. In particular, central trapping portion 1830 is configured with a generally concave shape with respect to bottom surface 1832. In other words, central trapping portion 1830 is disposed inward of bottom surface 1832. Preferably, this concave shape can accommodate the round shape of a ball to increase engagement with the ball. By facilitating engagement, central trapping portion 1830 may improve the trapping abilities of a wearer.

Preferably, sole system 1820 is configured with other provisions to enhance the trapping abilities of a wearer. Similar to the previous embodiment illustrated in FIG. 17, arch portion 1850 of sole system 1820 includes a shape configured with slot portions that compress to enable bending of arch portion 1850. Specifically, arch portion 1850 includes first slot portion 1851 and second slot portion 1852. First slot portion 1851 and second slot portion 1852 are disposed and shaped in a substantially similar manner to first slot portion 1751 and second slot portion 1752 of the previous embodiment illustrated in FIG. 17. Using this configuration, first slot portion 1851 and second slot portion 1852 can enable medial portion 1854 and lateral portion 1856 of sole system 1820 to bend in different manners. This preferred arrangement allows sole system 1820 to twist during finesse maneuvers. This can provide greater flexibility for sole system 1820 to accommodate a curling of toe portion 1819 when trapping a ball.

In some embodiments, a sole system with provisions for flexing can include an insole. An insole can be disposed adjacent to a foot inserted within an article. In embodiments using a generally rigid insole, the insole may interfere with the flexibility of an outsole. In a preferred embodiment, an insole may be configured to cooperate with provisions for flexibility in an outsole.

Figure 19:
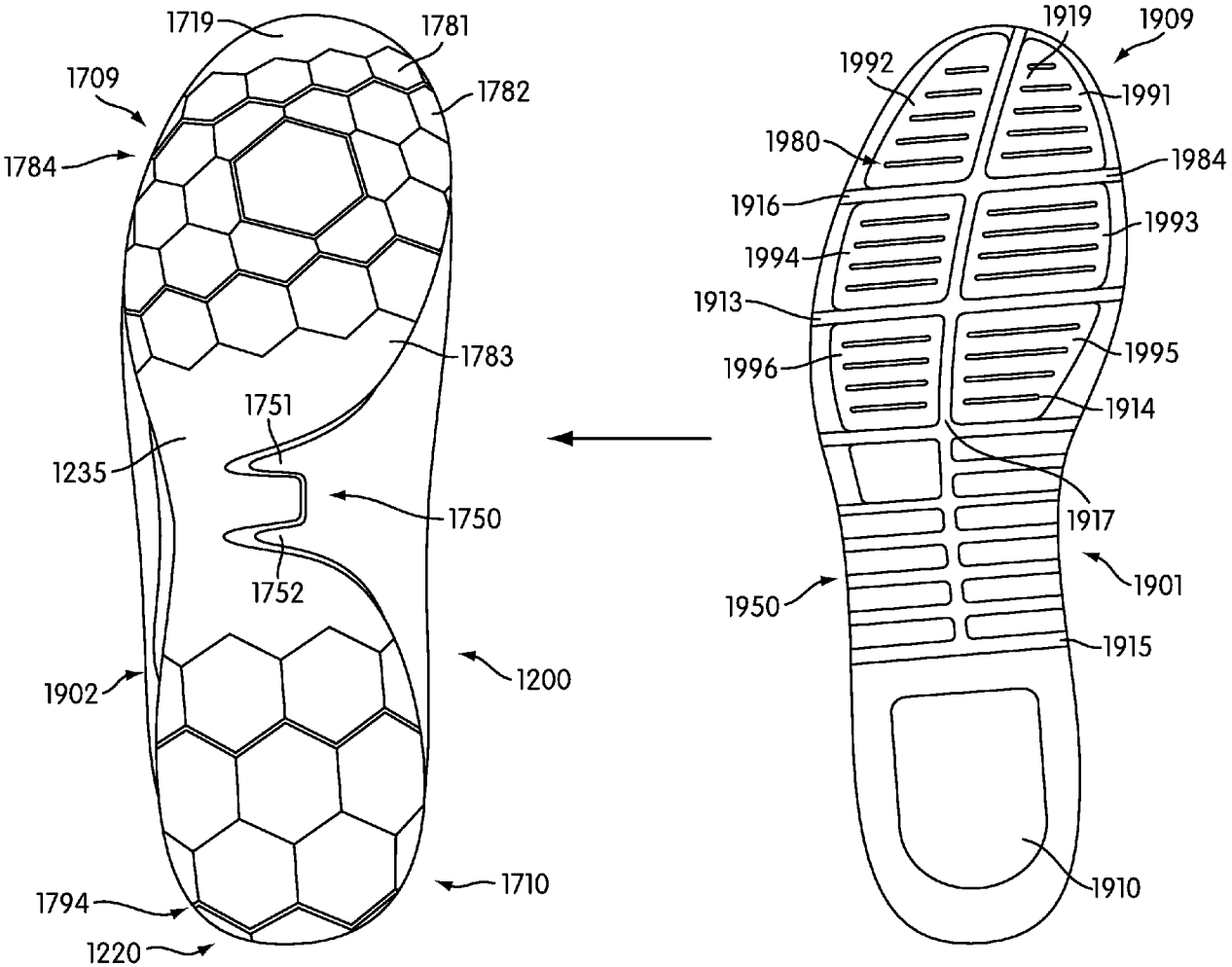
FIG. 19 is an exploded isometric view from underneath a preferred embodiment of an article of footwear including an insole.

FIG. 19 illustrates a preferred embodiment of article 1200 including sole system 1220 and insole 1901. In particular, the bottom surfaces of both sole system 1220 and insole 1901 are visible in this embodiment. Insole 1901 is preferably configured to contact a foot inserted within article 1200. Likewise, bottom surface 1235 may be associated with outsole 1902 of sole system 1220 and configured to contact a ground surface. Furthermore, sole system 1220 can include a midsole, as well as provisions for traction including, but not limited to cleats and traction elements, that are not illustrated in these Figures for purposes of clarity.

As previously discussed, bottom surface 1235 is configured with provisions to increase the flexibility of article 1200, as illustrated in FIG. 17. Specifically, bottom surface 1235 of outsole 1902 includes forefoot flexing groove set 1784 and heel flexing groove set 1794 to facilitate bending at forefoot portion 1709 and heel portion 1710. Furthermore, arch portion 1750 includes first slot portion 1751 and second slot portion 1752 that compress inward to allow arch portion 1750 to bend.

Preferably, insole 1901 is configured to cooperate with provisions for flexibility included on bottom surface 1235 of outsole 1902. In this embodiment, forefoot portion 1909 of insole 1901 includes first insole groove set 1984. First insole groove set 1984 preferably includes first groove 1913 and second groove 1916.

Generally, grooves of first insole groove set 1984 may be disposed in any manner on forefoot portion 1909. In some cases, grooves may be disposed in a longitudinal direction. In other cases, grooves may be disposed in a lateral direction. In still other cases, grooves may be disposed in a direction between the longitudinal direction and the lateral direction. In a preferred embodiment, grooves of first insole groove set 1984 may be oriented in a substantially lateral direction.

In some embodiments, arch portion 1950 of insole 1901 may include second insole groove set 1915. Second insole groove set 1915 may include any number of grooves. In a preferred embodiment, second insole groove set 1915 may comprise approximately 7 grooves.

Generally, grooves of second insole groove set 1915 may be disposed in any manner on arch portion 1950. In some cases, grooves may be disposed in a longitudinal direction. In other cases, grooves may be disposed in a lateral direction. In still other cases, grooves may be disposed in a direction between the longitudinal direction and the lateral direction. In a preferred embodiment, grooves of second insole groove set 1915 may be oriented in a substantially lateral direction.

In some embodiments, insole 1901 may further include longitudinal groove 1917 that extends in a longitudinal direction through forefoot portion 1909 and arch portion 1950. Preferably, longitudinal groove 1917 is configured to intersect with each of the grooves of first insole groove set 1984 and second insole groove set 1915. With this arrangement, longitudinal groove 1917 can also provide some lateral flexibility for insole 1901.

Forefoot portion 1909 may include provisions for increasing cushioning on insole 1901. In this embodiment, forefoot portion 1909 may include cushioning portion set 1980. Cushioning portion set 1980 may include first cushioning portion 1991, second cushioning portion 1992, third cushioning portion 1993, fourth cushioning portion 1994, fifth cushioning portion 1995 and sixth cushioning portion 1996.

In some embodiments, cushioning portions may be provided with slots for facilitating flexibility. In this embodiment, cushioning portion set 1980 may include slots 1914. Generally, each cushioning portion of cushioning portion set 1980 may include any number of slots. In some cases, each cushioning portion can include a single slot. In other cases, each cushioning portion can include two or more slots. In this preferred embodiment, each cushioning portion may include four slots.

Generally, slots 1914 can be oriented in any manner on cushioning portion set 1980. In some cases, slots 1914 can be oriented in a generally longitudinal direction. In other cases, slots 1914 can be oriented in a generally lateral direction. In still other cases, slots 1914 can be oriented in a direction between the lateral and longitudinal directions. In a preferred embodiment, slots 1914 may be oriented in a generally lateral direction in order to facilitate curling of toe portion 1919 of insole 1901.

Figure 20:
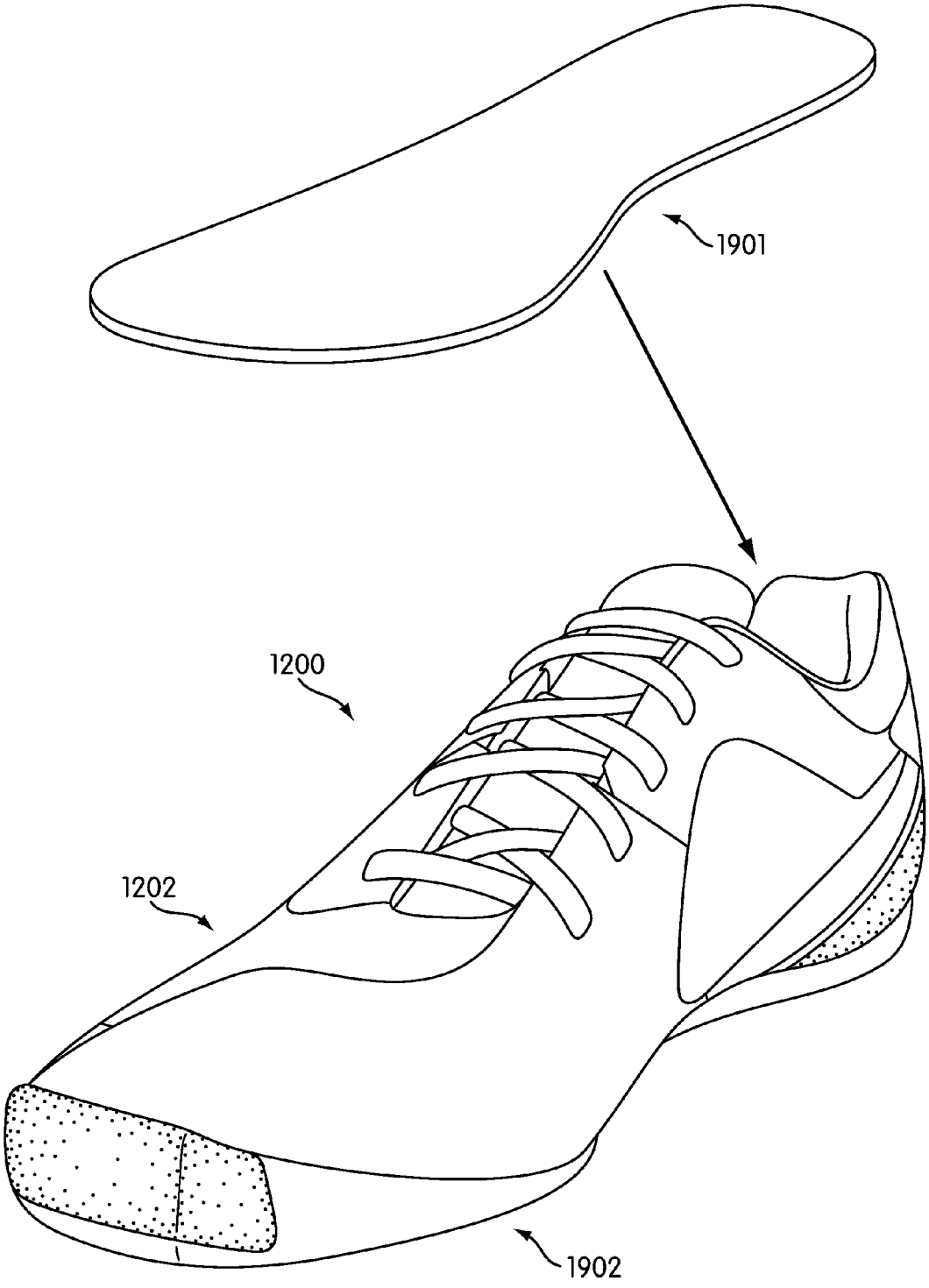
FIG. 20 is a side view of an exemplary embodiment of an insertion of an insole into an article of footwear.

Typically, insole 1901 may be inserted into an inner portion of upper 1202 through an opening for a foot disposed in upper 1202 and/or through lacing gap 1429, as illustrated in FIG. 20. In some cases, insole 1901 can be associated with article 1200 prior to a purchase of article 1200. In other cases, insole 1901 can be associated with article 1200 by a wearer of article 1200.

Figure 21:
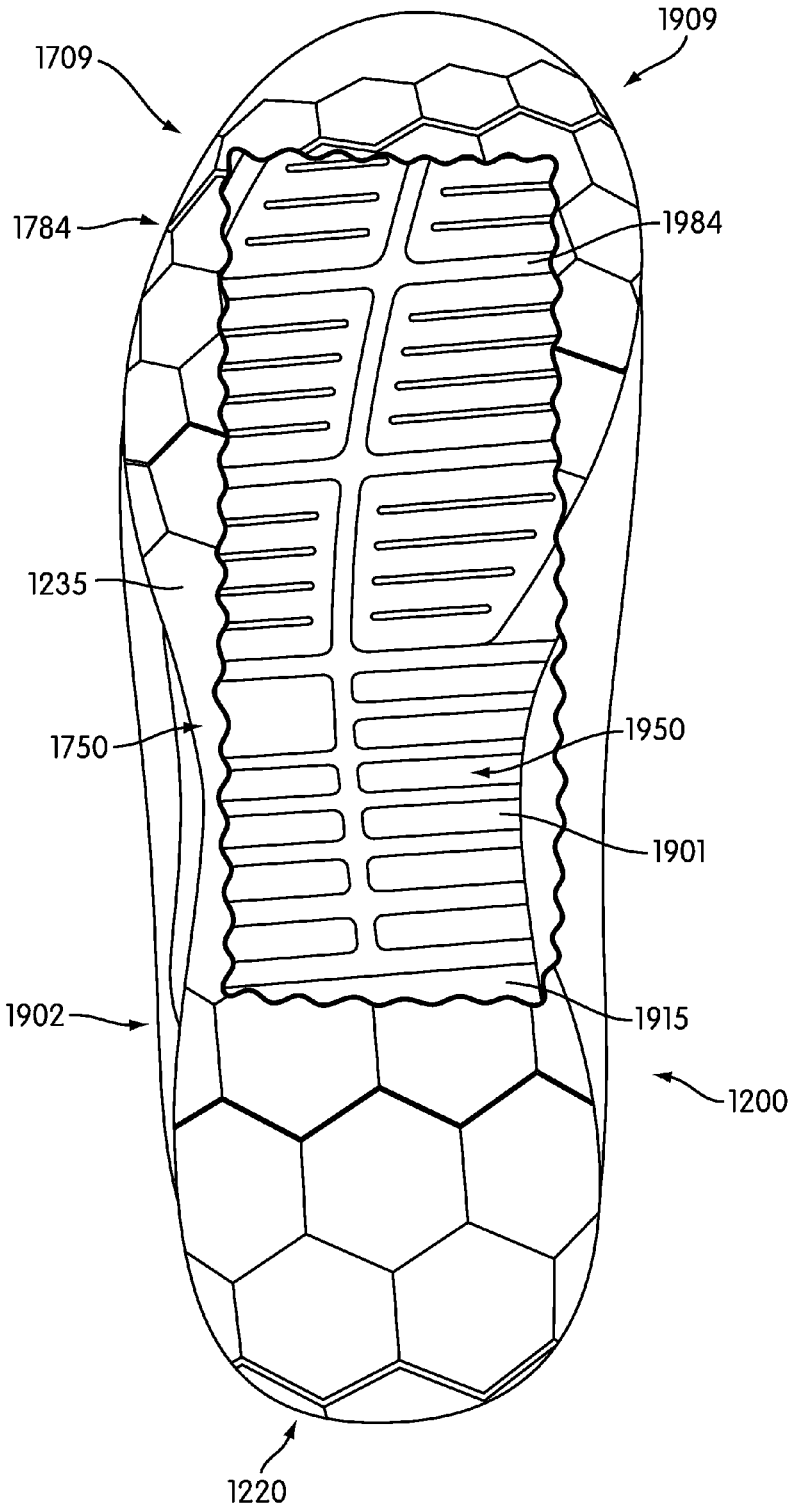
FIG. 21 is an isometric view from underneath a preferred embodiment of an article of footwear with an insole.

Preferably, grooves on an insole may be configured to cooperate with slot portions on an outsole to increase the flexibility of a sole system. Following the insertion of insole 1901 into article 1200, arch portion 1950 of insole 1901 may be aligned with arch portion 1750 of outsole 1902, as seen in FIG. 21. Referring to FIGS. 19 and 21, second insole groove set 1915 can be configured in any manner to cooperate with first slot portion 1751 and second slot portion 1752 of arch portion 1750. In some cases, first slot portion 1751 and second slot portion 1752 may be aligned with grooves of second insole groove set 1915. In other cases, first slot portion 1751 and second slot portion 1752 may be staggered with respect to grooves of second insole groove set 1915. In a preferred embodiment, first slot portion 1751 and second slot portion 1752 may be substantially aligned with adjacent grooves of second insole groove set 1915.

As illustrated in FIG. 21, forefoot portion 1909 of insole 1901 may also be aligned with forefoot portion 1709 of outsole 1902, once insole 1901 has been inserted into article 1200. Generally, first insole groove set 1984 can be configured in any manner to cooperate with flexing grooves disposed on forefoot portion 1709 of bottom surface 1235. In some embodiments, first insole groove set 1984 can be aligned with forefoot flexing groove set 1784 on forefoot portion 1709 of outsole 1902. In some cases, each groove of first insole groove set 1984 can correspond with a flexing groove of forefoot flexing groove set 1784. In a preferred embodiment, grooves of first insole groove set 1984 can be staggered with flexing grooves of forefoot flexing groove set 1784.

Typically, a wearer may use a toe portion of an article of footwear to pass or strike a soccer ball. In some cases, a wearer may use a lateral portion of a toe portion to make short and medium distance passes in a "give and go" passing situation. As discussed with respect to FIGS. 12-14, an asymmetrical toe bumper can provide greater surface area to contact a ball on a lateral portion of a toe portion.

Figure 22:
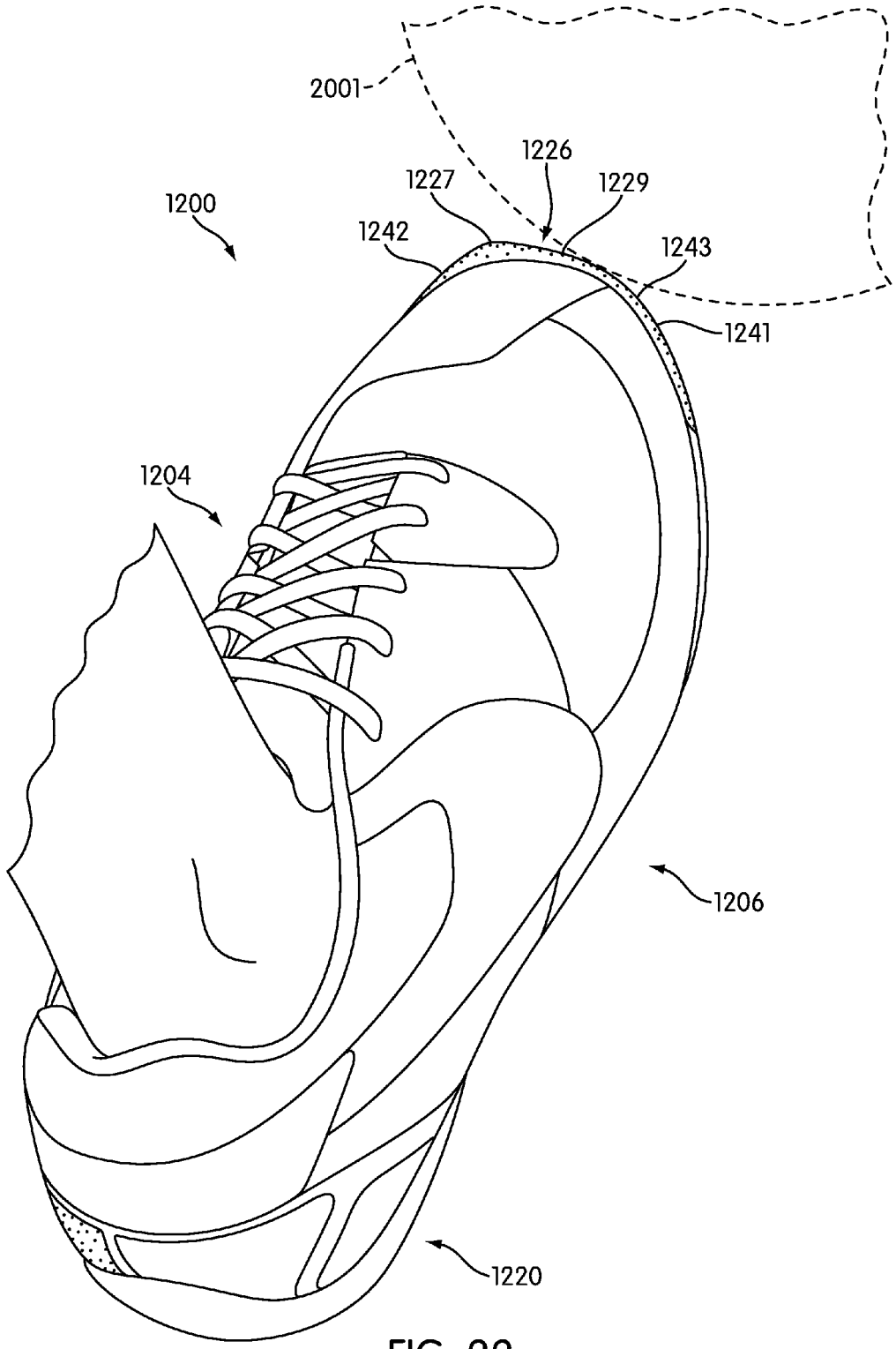
FIG. 22 is an isometric view of an exemplary embodiment of a wearer of an article of footwear passing a soccer ball with a toe bumper.

FIG. 22 illustrates an isometric view of an exemplary embodiment of a wearer of article 1200 passing soccer ball 2001. It should be understood that this embodiment is intended to be exemplary. In other embodiments, article 1200 may contact soccer ball 2001 in another manner in order to pass soccer ball 2001.

In this embodiment, a wearer of article 1200 contacts soccer ball 2001 with toe bumper 1229 disposed on front portion 1226 of sole system 1220. Specifically, standard curved portion 1241 disposed on lateral portion 1206 of toe bumper 1229 contacts soccer ball 2001. With textured surface 1243 on toe bumper 1229, standard curved portion 1241 preferably engages and grips soccer ball 2001.

In this preferred embodiment, standard curved portion 1241 preferably comprises a larger surface area due to the configuration of protrusion 1227 on toe bumper 1229. This greater surface area of standard curved portion 1241 can provide a stable contact point with soccer ball 2001. With this greater surface area as a stable contact point, a wearer of article 1200 can have greater accuracy when passing or striking soccer ball 2001 with standard curved portion 1241 of toe bumper 1229.

Figure 23:
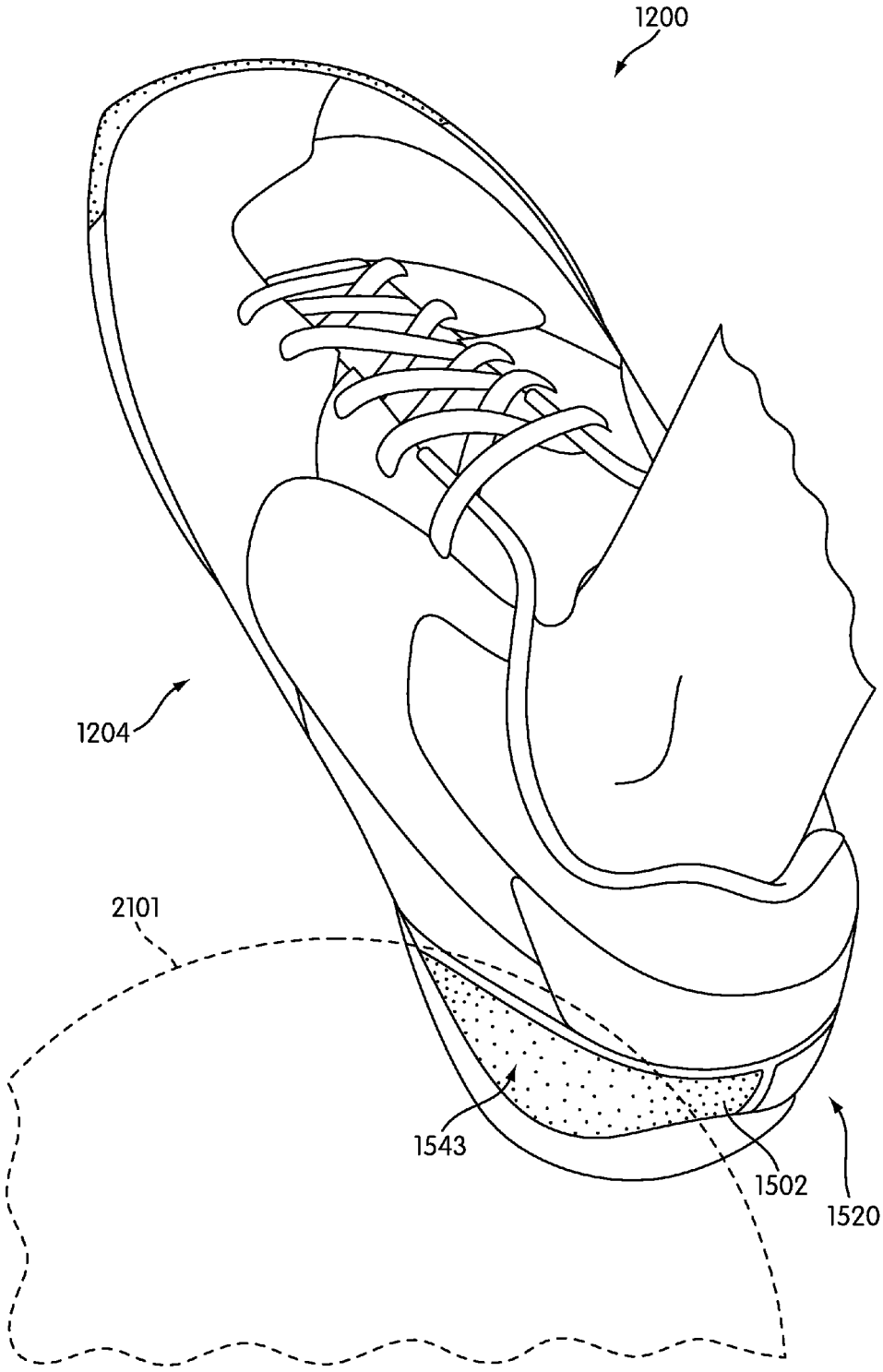
FIG. 23 is an isometric view of an exemplary embodiment of a wearer of an article of footwear passing a soccer ball with a heel bumper.

It is also possible that a wearer of an article configured for indoor soccer may pass or a strike a soccer ball with a medial portion of a heel portion of an article. An article can be configured with a heel bumper disposed on a medial portion of a heel portion to pass or strike a soccer ball, as illustrated in FIG. 15. FIG. 23 illustrates an exemplary embodiment of a wearer of article of footwear 1200 contacting soccer ball 2101 with heel bumper 1502. This embodiment is intended to be exemplary. In other embodiments, heel bumper 1502 can contact soccer ball 2101 in another manner.

Typically, only a portion of soccer ball 2101 may contact medial portion 1204 of heel portion 1520 during a heel pass. With a generally rounded triangular shape, heel bumper 1502 is configured with an asymmetrical shape that agrees with the shape of a portion of soccer ball 2101 that may contact medial portion 1204 of heel portion 1520 during a heel pass. Preferably, the asymmetrical shape of heel bumper 1502 facilitates contact with soccer ball 2101.

When heel bumper 1502 contacts soccer ball 2101, heel bumper 1502 preferably absorbs some of the impact of soccer ball 2101. Furthermore, a high coefficient of friction associated with textured surface 1543 of heel bumper 1502 can assist a wearer of article 1200 to engage soccer ball 2101 with heel bumper 1502. With this configuration, heel bumper 1502 provides an effective contact point to generate power and agility when striking or passing soccer ball 2101.

As previously discussed, a wearer of an article of footwear may catch a pass in order to trap a soccer ball. FIGS. 24-27 illustrate an exemplary embodiment of a wearer of article of footwear 1200 trapping soccer ball 2201. The scenario illustrated in this embodiment is intended to be exemplary. In other embodiments, a wearer of article of footwear 1200 may trap soccer ball 2201 in another manner.

Figure 24:
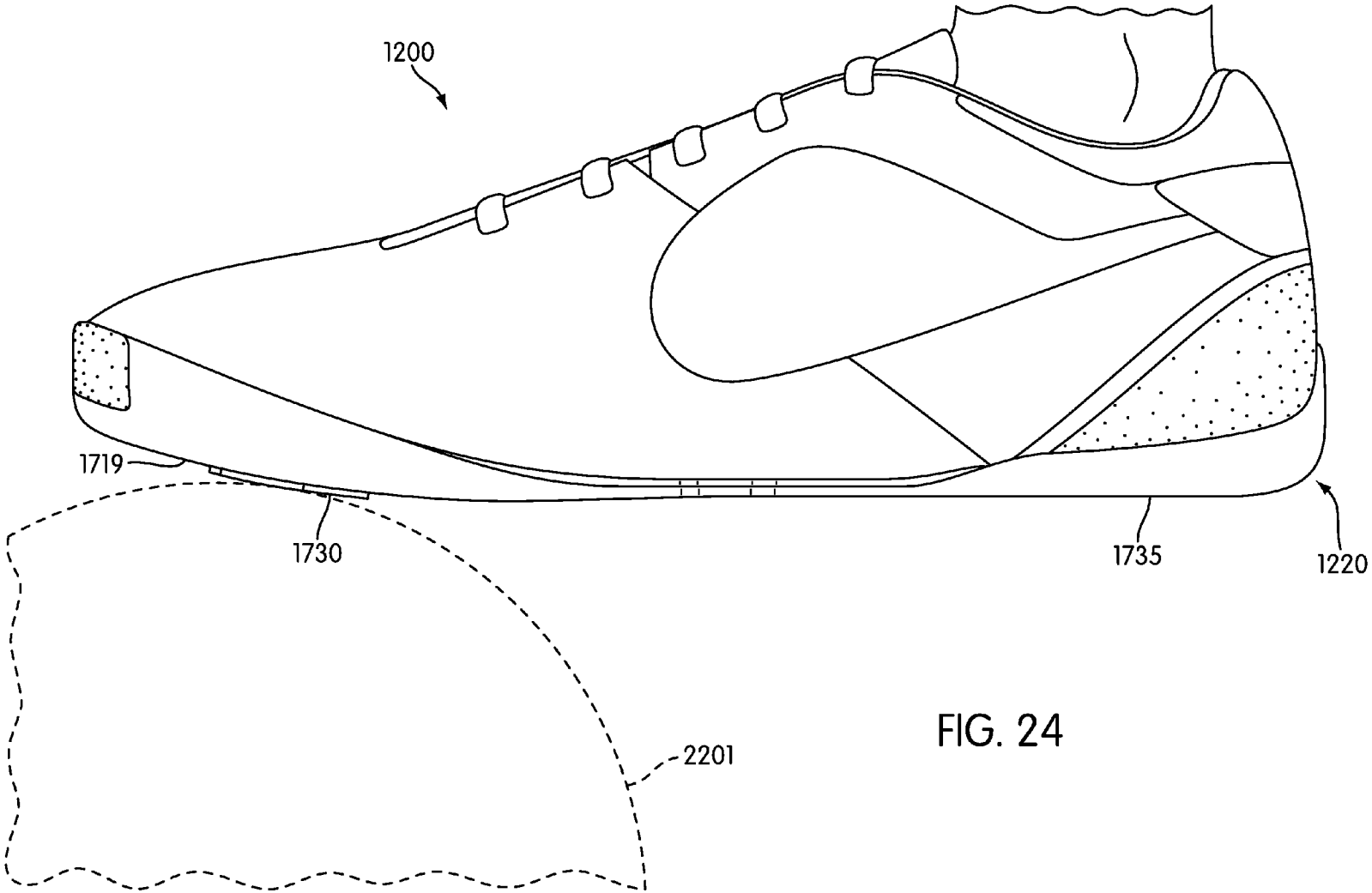
FIG. 24 is a side view of an exemplary embodiment of a wearer of an article of footwear trapping a soccer ball.

Referring to FIG. 24, soccer ball 2201 is stopped by toe portion 1719 of sole system 1220. In particular, central trapping portion 1730 contacts soccer ball 2201 to stop soccer ball 2201. Typically, the relatively high coefficient of friction of central trapping portion 1730 assists a wearer of article 1200 to trap soccer ball 2201. This configuration can enable central trapping portion 1730 to stick to a portion of soccer ball 2201 and prevent any further rolling of soccer ball 2201 beneath article 1200. In other embodiments, however, soccer ball 2201 may be trapped by other portions of article of footwear 1200.

Figure 25:
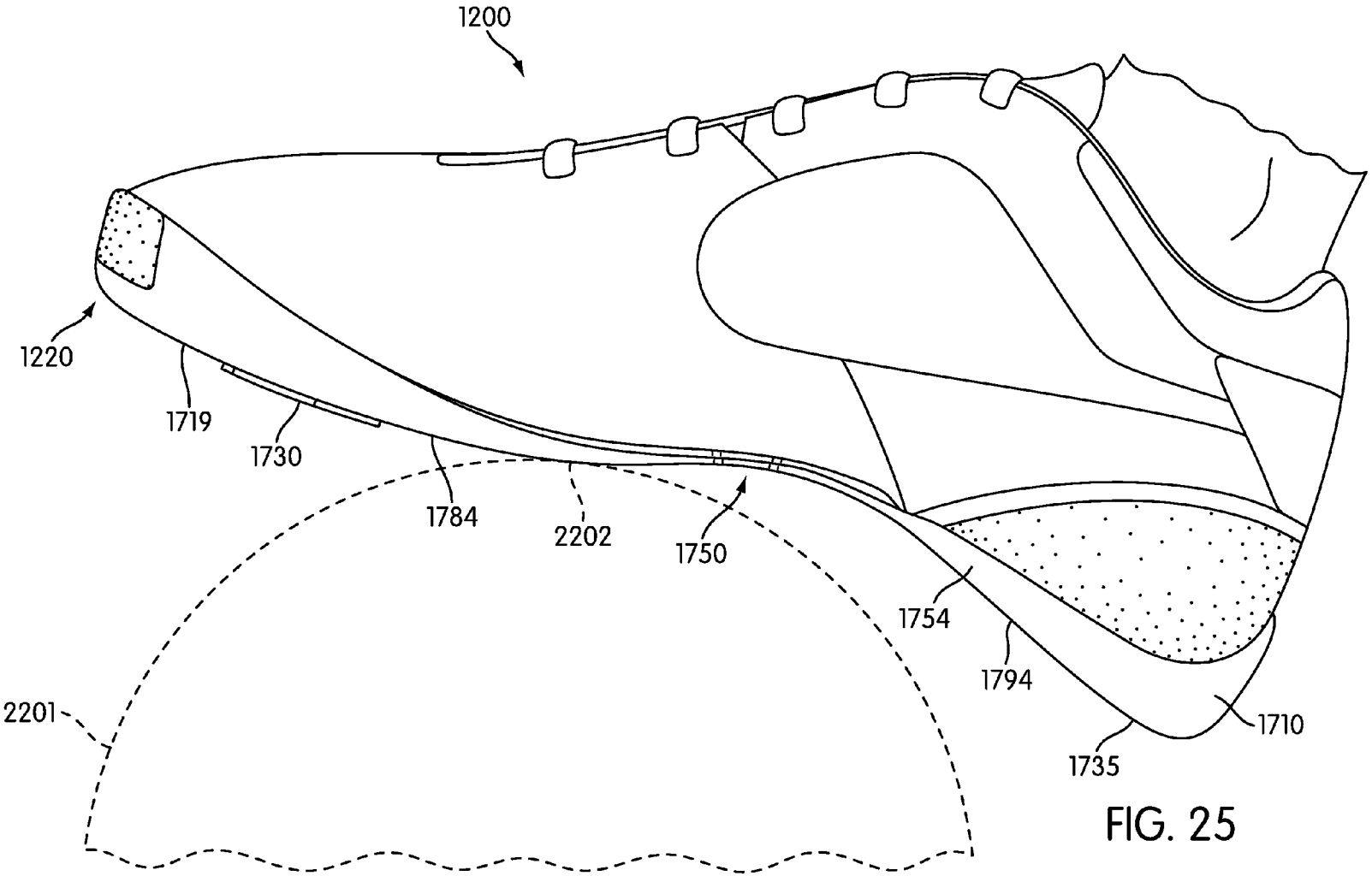
FIG. 25 is a side view of an exemplary embodiment of a wearer of an article of footwear trapping a soccer ball.
Figure 26:
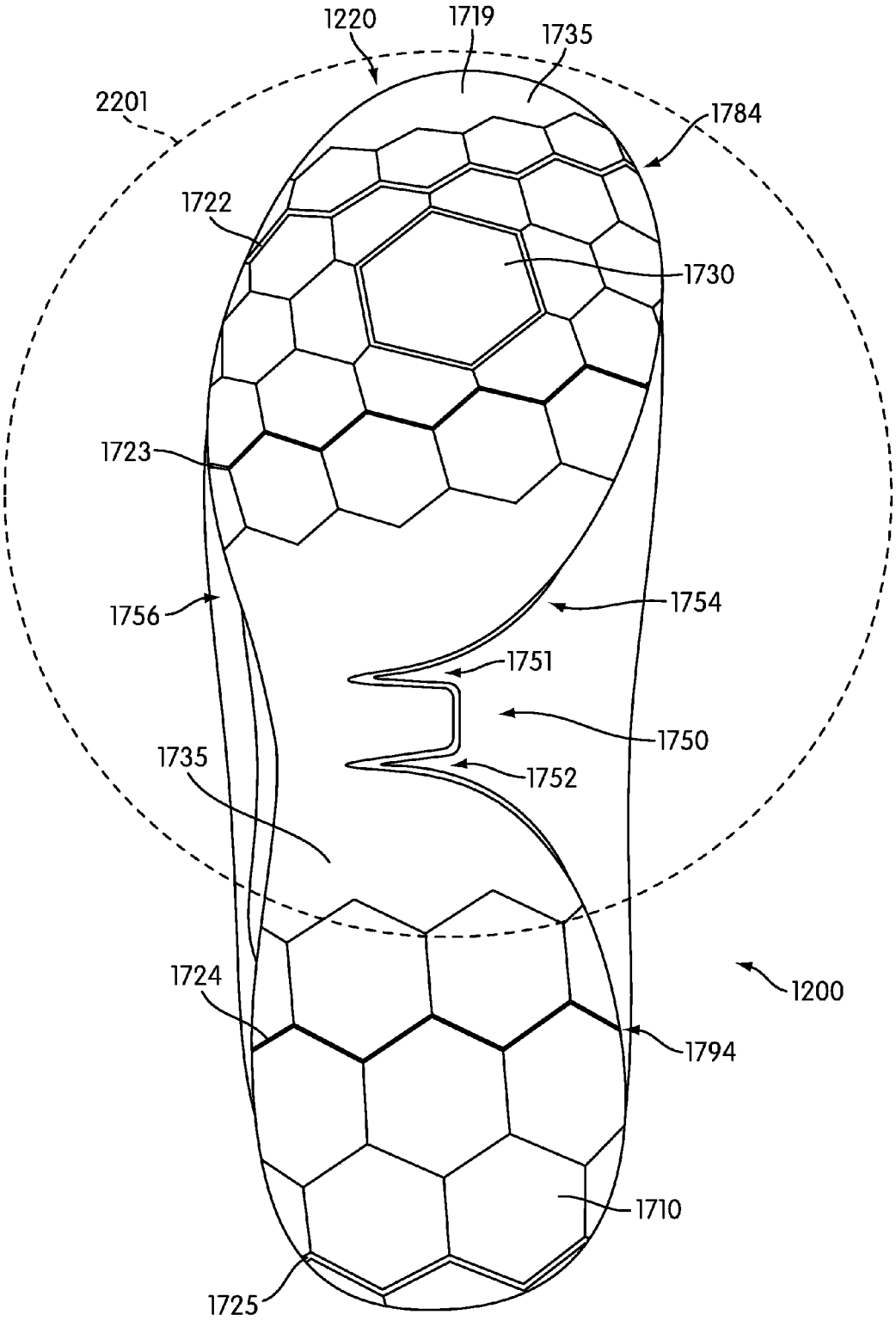
FIG. 26 is an isometric view from underneath an exemplary embodiment of an article of footwear trapping and compressing a soccer ball.
Figure 27:
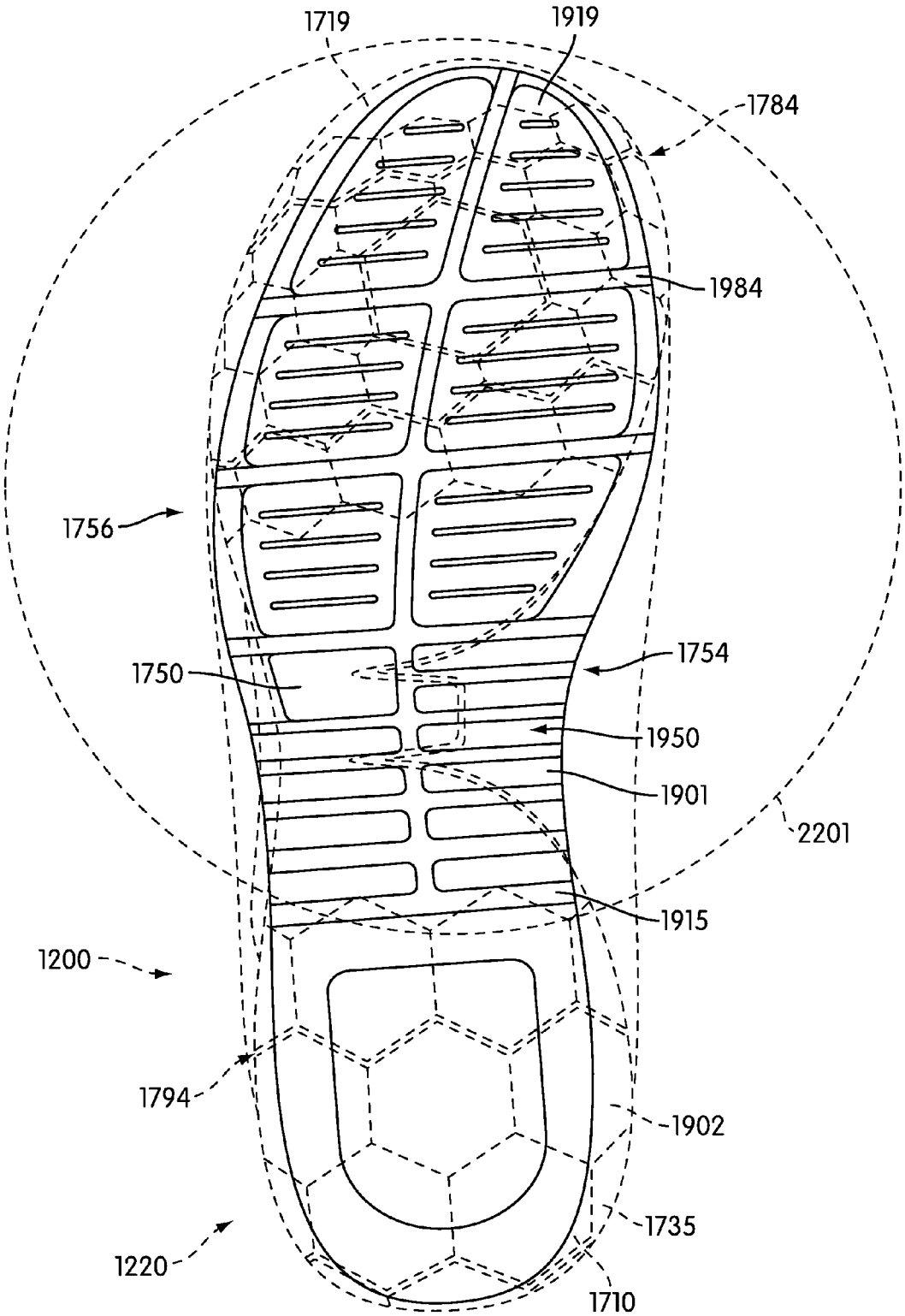
FIG. 27 is an isometric view from underneath an exemplary embodiment of an article of footwear with an insole trapping and compressing a soccer ball.

As previously discussed, in order to firmly trap a soccer ball, a wearer may curl a toe portion of an article of footwear toward the soccer ball. This allows the article to compress the soccer ball between a ground surface and the article. Referring to FIGS. 25-27, a wearer curls toe portion 1719 to firmly trap soccer ball 2201. This configuration can dispose arch portion 1750 adjacent to top portion 2202 of soccer ball 2201, as illustrated in FIG. 25. In particular, medial portion 1754 of arch portion 1750 may be disposed adjacent to top portion 2202 of soccer ball 2201 while lateral portion 1756 of arch portion 1750, not visible in FIG. 25, is disposed further from top portion 2202 of soccer ball 2201.

Referring to FIG. 26, soccer ball 2201 is illustrated in phantom so that bottom surface 1735 of sole system 1220 is visible. As a wearer traps soccer ball 2201, arch portion 1750 may arch upward. This can be accomplished by the inward compression of first slot portion 1751 and second slot portion 1752. With this inward compression, arch portion 1750 can arch upward and conform to the curvature of soccer ball 2201. This can allow arch portion 1750 greater control when trapping soccer ball 2201. By conforming to the curvature of soccer ball 2201, arch portion 1750 can exert greater control in compressing soccer ball 2201 toward a ground surface.

In this preferred embodiment, first slot portion 1751 and second slot portion 1752 are configured with shapes that cover a greater area on medial portion 1754 than lateral portion 1756 of sole system 1220. This configuration allows medial portion 1754 of arch portion 1750 to compress inward to a greater degree than lateral portion 1756. This can cause medial portion 1754 to bend to a greater degree than lateral portion 1756. Since a wearer of article 1200 may trap soccer ball 2201 with medial portion 1754 of arch portion 1750 disposed adjacent to top portion 2202 of soccer ball 2201, as illustrated in FIG. 25, the greater bending of medial portion 1754 can allow a wearer to exert greater control of soccer ball 2201. In other words, medial portion 1754 may undergo greater bending to conform to the curvature of top portion 2202 of soccer ball 2201. Similarly, lateral portion 1756 of arch portion 1750 may be disposed further from top portion 2202 of soccer ball 2201. Since lateral portion 1756 may bend to a lesser degree than medial portion 1754, arch portion 1750 may twist as well as arch to conform to the curvature of soccer ball 2201. Preferably, this configuration allows a wearer of article of footwear 1200 to exert greater control to compress soccer ball 2201 toward a ground surface and effectively trap soccer ball 2201.

Preferably, heel portion 1710 as well as forefoot portion 1709 may also bend to firmly trap soccer ball 2201. In this embodiment, forefoot flexing groove set 1784 and heel flexing groove set 1794 compress inward to allow forefoot portion 1709 and heel portion 1710, respectively, to bend to conform to the curvature of soccer ball 2201, as illustrated in FIGS. 25-27. With this arrangement, bottom surface 1735 can conform to the curvature of soccer ball 2201 and push soccer ball 2201 toward a ground surface to firmly trap soccer ball 2201.

Referring to FIG. 27, outsole 1902 of sole system 1220 is illustrated in phantom so that insole 1901 is visible within sole system 1220. As a wearer traps soccer ball 2201 and outsole 1902 conforms to a curvature of soccer ball 2201, insole 1901 preferably cooperates with provisions for flexibility disposed on outsole 1902. In particular, grooves of second insole groove set 1915 of arch portion 1950 compress inward to allow arch portion 1950 to arch upward. This arching cooperates with the upward arching of arch portion 1750 of outsole 1902. In addition, grooves of first insole groove set 1984 compress inward to allow toe portion 1919 to curl downward. With this configuration, toe portion 1919 can bend in a cooperating manner with toe portion 1719 of outsole 1902. Preferably, this configuration assists outsole 1902 to conform to the curvature of soccer ball 2201 and trap soccer ball 2201.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

We claim:

1. An article of footwear, comprising:

an upper; and a sole system having a bottom surface configured to contact a ground surface;

the bottom surface comprising an arch portion, a medial portion and a lateral portion;

the arch portion including at least a first V-shaped slot portion and a second V-shaped slot portion separated by a separating portion; and each of the first V-shaped slot portion and the second V-shaped slot portion having a wide portion open to the medial portion and a narrow portion disposed on the lateral portion;

wherein the first and second V-shaped slot portions and the separating portion form a continuous recessed periphery portion of the bottom surface and a portion of the upper is exposed through the first and second V-shaped slot portions adjacent the continuous recessed periphery portion of the bottom surface; and wherein the at least first and second V-shaped slot portions are configured to provide flexibility to the arch portion.

2. The article of footwear according to claim 1, wherein the first and second V-shaped slot portions are configured to accommodate twisting of the arch portion.

3. The article of footwear according to claim 1, wherein the first and second V-shaped slot portions are formed by removing a portion of the sole system from the arch portion.

4. The article of footwear according to claim 1, wherein a width of each V-shaped slot portion continually increases from the narrow portion disposed on the lateral portion to the wide portion open to the medial portion.

5. The article of footwear according to claim 1, wherein a shape of the separating portion is different from shapes of the first and second V-shaped slot portions.

6. The article of footwear according to claim 1, wherein the separating portion has a generally rectangular shape.

7. The article of footwear according to claim 1, wherein the first V-shaped slot portion has a first leg and a second leg that is longer than the first leg, and wherein the separating portion is shorter than the second leg of the first V-shaped slot portion.

8. The article of footwear according to claim 1, wherein the first and second V-shaped slot portions and the separating portion form a continuous recessed medial edge of the bottom surface of the sole system.

9. The article of footwear according to claim 1, wherein the first and second V-shaped slot portions are configured to provide a bending flexibility of the medial portion greater than a bending flexibility of the lateral portion.

10. An article of footwear, comprising:

an upper;

a sole system having a bottom surface configured to contact a ground surface and including an arch portion having at least two V-shaped slot portions separated by a separating portion disposed therebetween, a medial portion and a lateral portion, each V-shaped slot portion having a wide portion open to the medial portion and a narrow portion disposed on the lateral portion; and an insole disposed within the article of footwear, the insole including an arch portion having at least one groove disposed in a lateral direction;

wherein one of the at least two V-shaped slot portions extends in a generally lateral direction and is disposed adjacent to the at least one groove in the arch portion of the insole;

wherein the at least two V-shaped slot portions and the separating portion form a recessed periphery portion of the bottom surface;

wherein a portion of the upper is exposed through the wide portions of the at least two V-shaped slot portions forming the recessed periphery portion; and wherein said one of the at least two V-shaped slot portions is configured to cooperate with the at least one groove in the insole to facilitate flexibility of the sole system and the insole.

11. The article of footwear according to claim 10, wherein the arch portion of the insole includes at least two grooves.

12. The article of footwear according to claim 10, wherein the sole system includes a forefoot portion having at least one flexing groove configured to facilitate a bending flexibility of the sole system.

13. The article of footwear according to claim 12, wherein the insole includes a forefoot portion having at least one groove configured to facilitate a bending flexibility of the insole.

14. The article of footwear according to claim 13, wherein the at least one flexing groove of the forefoot portion of the sole system corresponds with the at least one groove of the forefoot portion of the insole.

15. The article of footwear according to claim 10, wherein a width of each V-shaped slot portion continually increases from the narrow portion disposed on the lateral portion to the wide portion open to the medial portion.

16. The article of footwear according to claim 10, wherein a shape of the separating portion is different from shapes of the at least two V-shaped slot portions.

17. The article of footwear according to claim 10, wherein the separating portion has a generally rectangular shape.

18. The article of footwear according to claim 10, wherein a first V-shaped slot portion has a first leg and a second leg that is longer than the first leg, and wherein the separating portion is shorter than the second leg of the first V-shaped slot portion.

19. The article of footwear according to claim 10, wherein the bottom surface has a greater width in the lateral direction at the separating portion than at the V-shaped slot portions.

20. The article of footwear according to claim 10, wherein the sole system further includes a toe portion and a heel portion; and wherein the arch portion is more narrow from the medial portion to the lateral portion than both the toe portion and the heel portion due to the recessed periphery portion formed by the at least two V-shaped slot portions.

21. The article of footwear according to claim 10, wherein the at least two V-shaped slot portions and the separating portion form a continuous portion of a medial edge of the bottom surface of the sole system.

22. The article of footwear according to claim 10, wherein the insole is configured to be removably disposed within the article of footwear.

23. An article of footwear, comprising:

an upper; and a sole system having a bottom surface configured to contact a ground surface and including a forefoot portion, an arch portion, and a heel portion;

the arch portion including a first V-shaped slot portion, a second V-shaped slot portion, a separating portion disposed between the first and second V-shaped slot portions, a medial portion, and a lateral portion;

wherein the first V-shaped slot portion and the second V-shaped slot portion each provide a recessed periphery portion of the bottom surface in a medial to lateral direction, and wherein the recessed periphery portion forms an opening through the bottom surface of the sole system, wherein a portion of the upper is exposed through the opening;

wherein the first V-shaped slot portion is recessed further than the separating portion in the medial to lateral direction;

the first V-shaped slot portion having a first wide portion open to the medial portion and a first narrow portion disposed on the lateral portion;

the second V-shaped slot portion having a second wide portion open to the medial portion and a second narrow portion disposed on the lateral portion;

the first V-shaped slot portion being disposed adjacent to the forefoot portion; and the second V-shaped slot portion being disposed adjacent to the heel portion.

24. The article of footwear according to claim 23, wherein the separating portion has a generally rectangular shape.

25. The article of footwear according to claim 23, wherein the first V-shaped slot portion and the second V-shaped slot portion facilitate twisting of the forefoot portion with respect to the heel portion.

26. The article of footwear according to claim 23, wherein the sole system includes at least one flexing groove associated with one or more of the forefoot portion and the heel portion.

27. The article of footwear according to claim 23, wherein a width of each V-shaped slot portion continually increases from the narrow portion disposed on the lateral portion to the wide portion open to the medial portion.

28. The article of footwear according to claim 23, wherein a shape of the separating portion is different from shapes of the first and second V-shaped slot portions.

29. The article of footwear according to claim 23, wherein the first V-shaped slot portion has a first leg and a second leg that is longer than the first leg, and wherein the separating portion is shorter than the second leg of the first V-shaped slot portion.

30. The article of footwear according to claim 23, wherein the sole system has a continuous bottom surface including the forefoot portion, the arch portion, and the heel portion.

* * * * *